United States Patent [19]

Moorhouse et al.

[11] Patent Number: 4,834,059

[45] Date of Patent: May 30, 1989

[54] AIR GUN WITH SAFETY FEATURES

[75] Inventors: Harry R. Moorhouse, Ridgewood; Robert M. Jensen, Bloomfield, both of; Tat K. Chung, Chai Wan, Hong Kong

[73] Assignee: LJN Toys, Ltd., New York, N.Y.

[21] Appl. No.: 168,675

[22] Filed: Mar. 16, 1988

[51] Int. Cl.[4] ..... F41B 1/02; F41B 7/08

[52] U.S. Cl. ..... 124/67; 124/63; 124/40; 124/31; 124/45; 124/48; 124/51 R; 42/70.01

[58] Field of Search ..... 124/63, 64, 65, 66, 124/67, 68, 40, 31, 45, 48, 51 A, 51 R; 42/70.01, 70.04, 70.02, 70.08

[56] References Cited

U.S. PATENT DOCUMENTS

| | | | |
|---|---|---|---|
| 172,582 | 1/1876 | Pope . | |
| 182,899 | 10/1876 | Cross . | |
| 1,560,733 | 11/1925 | Roe | 124/40 |
| 1,816,091 | 7/1931 | Schmeisser . | |
| 1,824,503 | 9/1931 | Russell | 124/40 |
| 2,097,866 | 11/1937 | Tomlinson . | |
| 2,147,003 | 2/1939 | Von Kozurik . | |
| 2,237,678 | 4/1941 | Lohr et al. . | |
| 2,457,929 | 1/1949 | Slockbower | 42/70.01 |
| 2,505,428 | 4/1950 | Pope . | |
| 2,581,505 | 1/1952 | Wells | 124/66 |
| 2,633,838 | 4/1953 | Seward | 124/67 |
| 2,803,910 | 8/1957 | Lyle | 42/70.08 |
| 3,212,490 | 10/1965 | Merz . | |
| 3,547,095 | 12/1970 | Vadas et al. . | |
| 3,612,026 | 10/1971 | Vadas et al. . | |
| 3,693,609 | 9/1972 | Vodinh . | |
| 3,704,536 | 12/1972 | Kratt . | |
| 3,765,396 | 10/1973 | Kienholz et al. | 124/65 |
| 3,788,298 | 1/1974 | Hale . | |
| 3,913,553 | 10/1975 | Braughler et al. . | |
| 4,105,885 | 8/1978 | Orenstein | 42/70.01 |
| 4,531,503 | 7/1985 | Shepherd . | |
| 4,677,781 | 7/1987 | Lee | 42/70.01 |

FOREIGN PATENT DOCUMENTS

| | | | |
|---|---|---|---|
| 589315 | 12/1959 | Canada | 124/66 |

OTHER PUBLICATIONS

Washington Post, "Device Could Have Foiled Slaying of D.C. Officer", Lewis et al., Section C, p. 2, Oct. 19, 1976.

*Primary Examiner*—Randolph A. Reese
*Assistant Examiner*—Anthony Knight
*Attorney, Agent, or Firm*—Amster, Rothstein & Ebenstein

[57] ABSTRACT

A gun, which compresses a spring during cocking and uses the air accelerated by the spring to propel a projectile during firing, incorporates several safety features. The size of the handle makes it impossible for children to operate. The trigger cannot be moved to its firing position unless the gun is cocked, the gun housing is closed, and a manual safety button is actuated during firing. To prevent unintended projectiles from being inserted into the barrel, the front of the barrel is blocked except during firing and the rear of the barrel is blocked at all times by either the projectile-carrying magazine or a barrel block.

23 Claims, 10 Drawing Sheets

10
10
100
132
134
146
156
157
160
162
166
172
176
188
189
190
191
192
193
194
195
14
24

AIR GUN WITH SAFETY FEATURES

BACKGROUND OF THE INVENTION

The present invention relates generally to guns which compress a spring and are operable by the acceleration of air by the spring to fire a projectile, and more particularly to such a gun affording a high degree of safety.

As disclosed in U.S. Pat. No. 4,531,503, there has recently come into vogue a type of game, mainly for adult participation, based on the theme of survival under war-like conditions. The weapons used in these games are generally pistols which utilize a compressed gas to fire a hollow projectile filled with dye or the like which leaves a mark on the target, whether that target be an inanimate object or a participant in the game, hopefully without any further damage. U.S. Pat. No. 3,788,298 discloses that pistols of this type are used to fire hollow plastic or gelatin balls filled with a liquid such as paint to mark trees in forestry projects and to mark animals in conservation or farming projects. Unfortunately, these guns, like real guns, have evoked an outcry from those who fear damage or mischief as a result of the guns coming into the possession of children or unscrupulous characters. Intemperate of immature users may fail to observe the niceties of where the gun should be aimed (for example, to avoid the projectile hitting people in the eye), fire the gun inadvertently (because the safety mechanism has been left in the enabling position), or use the gun to fire projectiles other than the intended ones (by inserting substitute projectiles into the front or rear end of the barrel so that when the gun is fired the substitute projectile is propelled forward by the compressed air, either instead of or along with the intended projectile). Even in the hands of responsible adults, however, such guns can cause injury where they are misaimed or where the intended projectile is fired without the housing being properly sealed so that the dye or paint can spray back out of the housing and onto the person firing the gun.

For any one or more of the foregoing reasons, guns of this type may be deprecated by parents, law enforcement officers, municipalities and the like, with many parents and at least some municipalities expressing their disfavor by seeking bans on at least certain types of these guns.

Accordingly, it is an object of the present invention to provide an air gun which does not have the foregoing failings.

Another object is to provide such a gun which cannot be inadvertently fired.

Still another object is to provide such a gun which cannot be operated by the small hands of young children.

A further object is to provide such a gun which cannot be fired when the housing is not sealed against backfiring on the user.

It is also an object to provide such a gun in which objects other than the intended projectiles cannot be inserted into the barrel from either end thereof.

It is another object to provide such a gun which utilizes a projectile-carrying magazine which resists loading with unintended simulated projectiles.

It is a further object to provide such a gun which is of rugged and economical construction, yet easy to manufacture and maintain.

SUMMARY OF THE INVENTION

The above and related objects of the present invention are attained in a gun for projecting a projectile comprising a housing or frame defining a handle for holding the gun and a barrel from which the projectile is projected. A trigger is movable relative to the frame between a rest position and a firing position. The gun includes means for removably receiving a projectile within the frame adjacent the rear end of the barrel, and means for projecting the projectile through the barrel and out of the gun when the trigger is moved to the firing position.

As a safety feature, blocking means are disposed adjacent the front end of the barrel for preventing the insertion of objects into the barrel from the front thereof rearwardly of the blocking means. The blocking means is movable between an operative position, wherein it extends substantially across the barrel and in the travel path of the projectile, and an inoperative position, wherein it is spaced from the travel path of the projectile. Means, operative in response to movement of the trigger between its rest position and its firing position, move the blocking means to its inoperative position when the trigger is in its firing position and to its operative position when the trigger is not in its firing position.

In a preferred embodiment the blocking means is pivotally secured at one end to the frame for movement between its operative and inoperative positions and the operative portion of the barrel forwardly of the blocking means is of greater cross section than the operative portion of the barrel rearwardly of the blocking means. The moving means includes means biasing the blocking means to its operative position, and is operative, in response to movement of the trigger from its firing position to its rest position, for enabling the biasing means to move the blocking means to its operative position.

As another safety feature, the distance between the rear of the handle and the front of the trigger in its rest position, in a horizontal plane passing through the trigger parallel to the barrel, is at least 8 centimeters, thereby to prevent simultaneous gripping of the handle and the trigger (and, therefore, operation of the gun) by the hand of a person of small stature.

As a further safety feature, a first safety firing means is disposed on the handle, the first safety firing means being movable between an enabling position, enabling movement of the trigger from its rest position to its firing position, and a non-enabling position, precluding movement of the trigger from its rest position to its firing position. Means bias the first safety firing means to its non-enabling position.

Preferably the gun is devoid of any means for maintaining the first firing safety means in its enabling position so that the user must manually maintain the first safety firing means in its enabling position against the influence of the biasing means. Where the first safety firing means is a push button, the biasing means biases the push button outwardly of the handle. In that situation, it is required that the user hold the push button in in order to activate the trigger.

Typically the frame or housing defines an aperture to permit placement of the projectile within the housing and the gun additionally comprises closure means movable between an open position, wherein the closure means substantially exposes the aperture of the housing, and a closed position, wherein the closure means substantially covers the aperture of the housing. As still another safety feature, the gun includes a second safety firing means also movable between an enabling position, enabling movement of the trigger from its rest position to its firing position, and a non-enabling position, precluding movement of the trigger from its rest position to its firing position. The gun includes means for moving the second safety firing means from its enabling position to its non-enabling position when the closure means is not in its closed position, and the closure means includes means adapted to move the second safety firing means from its non-enabling position to its enabling position when the closure means is in its closed position. Thus the trigger may be moved to its firing position only when the closure means substantially covers the housing aperture.

Preferably the means for moving the second firing safety means from its enabling position to its non-enabling position comprises biasing means. The trigger is movable to its firing position only when both the first and second safety firing means are in their enabling positions.

Typically the gun has a housing having an open top and a stock slidable along the barrel between a top-opening position wherein the housing open top is exposed and a top-closing position wherein the housing open top is closed by the stock. The housing is adapted to receive therein through the open top a magazine containing projectiles. The stock preferably further comprises means for cocking the projecting means as the stock moves from its top-closing position to its top-opening position, and means for indexing the magazine as the stock moves from its top-opening position to its top-closing position. Means preclude movement of the trigger to its firing position when the stock is not in its top-closing position, and means immobilize the magazine against indexing when the stock in its top-closing position.

In a preferred embodiment of the gun, a longitudinally extending barrel tube is coaxially disposed within the barrel and longitudinally movable between a forward position, wherein the rear end of the tube is substantially spaced from the magazine, and a rearward position, wherein the rear end of the tube is closely adjacent the magazine. A barrel block is disposed adjacent the front of the magazine when the magazine is received in the receiving means. The block in the absence of the magazine blocks passage therethrough by the rear end of the tube to maintain the tube in its forward position and blocks access to the rear end of the tube. The block in the presence of the magazine permits passage therethrough by the rear end of the tube to allow movement of said tube to its rearward position and enable access of a projectile from the magazine into the rear end of the tube. Thus, as an additional safety feature, projectiles from the magazine may be projected into the rear end of the tube but the rear end of the tube is not accessible for firing objects not contained in the magazine.

Preferably the block has a member movable between a blocking position, blocking access to the rear end of the tube and maintaining the tube in its forward position, and an enabling position, allowing the tube to move through the block and into its rearward position. The block additionally comprising means for moving the movable member from its enabling position to its blocking position, but permits movement of the movable member to its enabling position in response to the receipt of the magazine by the receiving means. The moving means may comprise means for biasing the movable member towards its blocking position. The gun additionally comprises means for biasing the tube to its rearward position where it is in fluid-tight communication with the magazine.

The present invention further resides in a kit comprising a gun for projecting a paint-containing projectile and a cleaning magazine adapted to be removably disposed within the frame adjacent to the rear end of the barrel in the manner of the projectile-containing magazine. The cleaning magazine contains a flexible cleaning rod extending therethrough, the cleaning rod having one exposed end adapted to be grasped by a person cleaning the barrel and the other end aligned with the rear end of the barrel. Reciprocation of the one end of the cleaning rod by the user causes the other end of the cleaning rod to enter and reciprocate within the barrel to clean the same of any accumulated paint from previously projected projectiles.

Preferably the gun further comprises a normally closed barrel block adapted to be opened by a projectile-containing magazine, and the cleaning magazine further comprises means for opening the barrel block.

The present invention also encompasses a projectile-containing magazine for use in a gun having a normally closed barrel block. The magazine comprises a carousel defining consecutive radial sectors comprising a plurality of chambers for carrying projectiles, a safety sector and an empty sector. A stator contains lugs for opening the normally-closed barrel block and exposing only one of the sectors at a time for firing. Means enable indexing of the carousel from the safety sector through the projectile-containing chambers to the empty sector.

Preferalby the means for enabling indexing precludes indexing from the empty sector to the safety sector. The magazine additionally comprises means for resisting indexing and precluding reverse indexing of the carousel relative to the stator. The resisting and precluding means additionally comprises means for aligning consecutively the chambers and empty sector in a position for firing.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
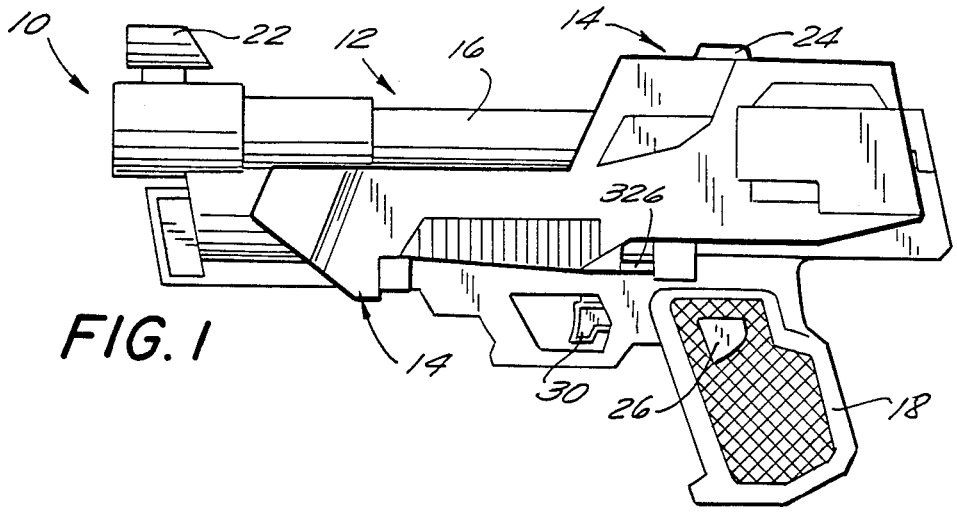
FIG. 1 is a side elevation view of a gun according to the present invention with the stock slightly displaced forwardly from its firing position.

Referring now to the drawing, and in particular to FIGS. 1–6 thereof, therein illustrated is a gun according to the present invention, generally designated by the reference numeral 10. Essentially, the gun 10 is defined in its outward appearance by a housing generally designated 12 and a stock generally designated 14 which surrounds portions of the housing 12 and is adapted for reciprocal translation relative to the housing 12. More particularly, the housing 12 defines a longitudinally-extending barrel 16 through which the gun fires projectiles and a hand grip or handle 18 by which the gun is held during firing by the hand 20 of a user (see FIG. 3). The handle 18 extends generally transverse to the barrel 16, as is conventional in a pistol. The handle 18 may have knurled portions to facilitate gripping thereof and the stock 14 may also have knurled portions to facilitate gripping thereof during the cocking of the gun. A front aiming sight 22 is disposed on the top of the front of the barrel 16, and a rear sight 24 is disposed on the top of the rear of the stock 14.

Extending through an aperture in one side of the handle 18 is a safety button 26 and extending through an aperture in the housing leading into the trigger guard area 28 is a portion of the trigger 30. As best seen in FIGS. 4–7, the trigger 30 is biased forwardly by means of springs 31 and 32 having their forward ends bearing forwardly on the rear surfaces of the trigger 30 and their rear ends bearing rearwardly on the front surfaces of housing bosses 33 and 34, respectively. The functions of the safety button 26 and trigger 30 will be explained hereinafter.

Figure 2:
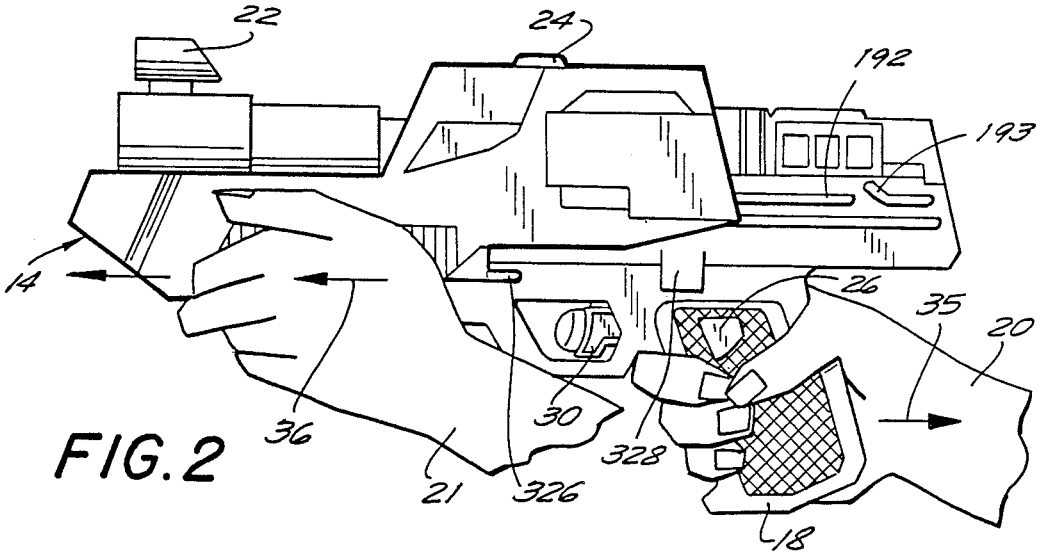
FIG. 2 is a fragmentary side elevation view of the gun held by the user after the gun has been cocked.
Figure 3:
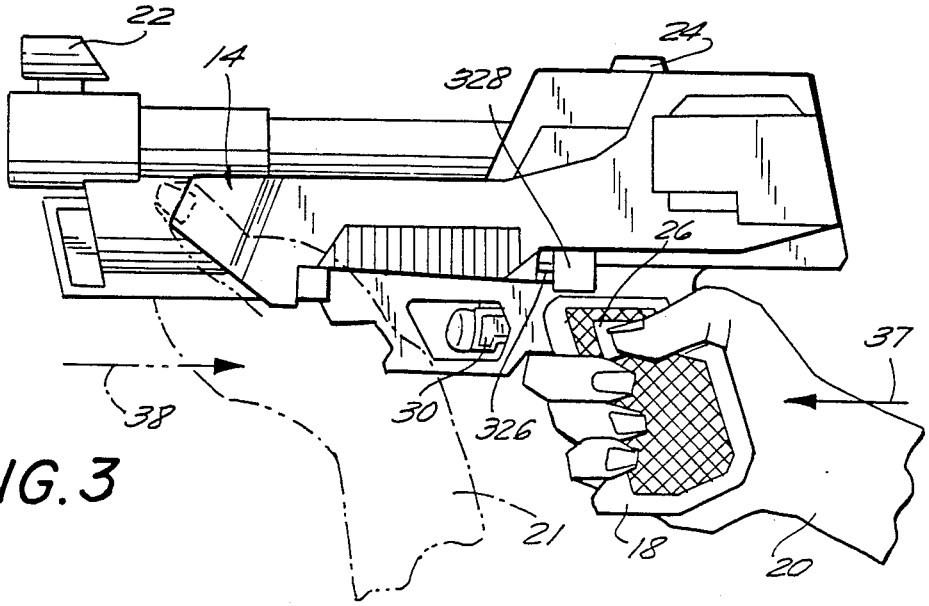
FIG. 3 is a fragmentary side elevation view of the gun held by the user with the stock returned to the firing position, with the stock-holding hand being shown in phantom-line.

The stock 14 is reciprocatively translatable along the longitudinal axis of barrel 16 between a cocking position shown in FIG. 2 and a firing position shown in FIG. 3. In order to cock the gun and reveal the open top of the housing 12 for insertion and removal of the projectile-containing magazine, the handle 18 is held in one hand 20 of the user and the stock 14 is held in the other hand 21 of the user; the two hands are then moved in opposite directions as indicated by the oppositely directed arrows 35, 36, respectively. To move the stock 14 into the firing position and cover the open top of the housing 12, the hands 20, 21 are moved closer together as indicated by the mutually facing arrows 37, 38, after which the hand 21 holding the stock 14 may be removed. FIG. 1 illustrates the gun just starting to be cocked, the stock 14 having been moved from the fired firing position of FIG. 3 slightly just toward the cocked position of FIG. 2.

Figure 4:
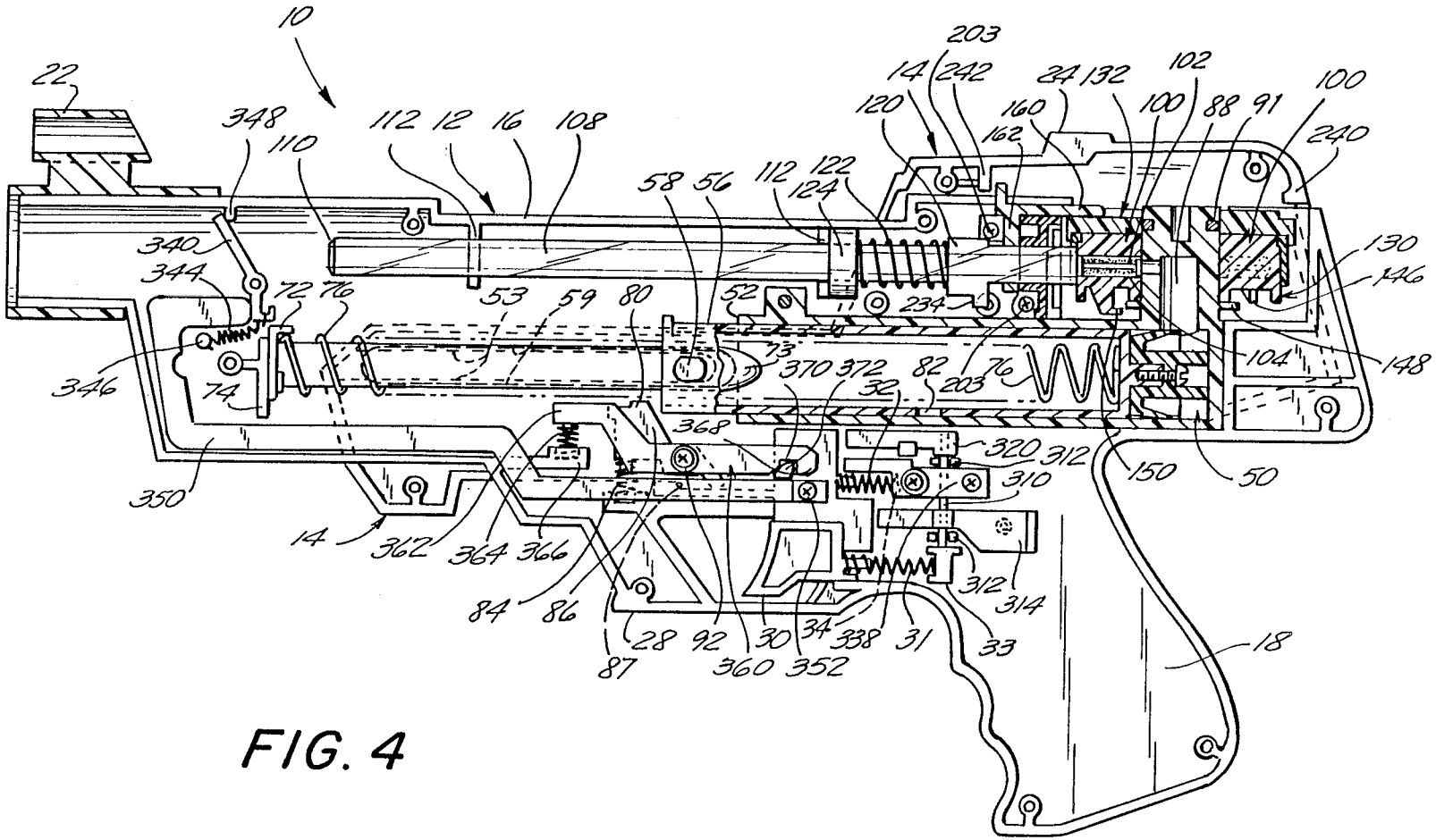
FIG. 4 is a side elevation view, to an enlarged scale, partially in cross section and with portions of the stock and housing removed to reveal details of internal construction, with the parts thereof shown in the position corresponding to FIG. 1.
Figure 5:
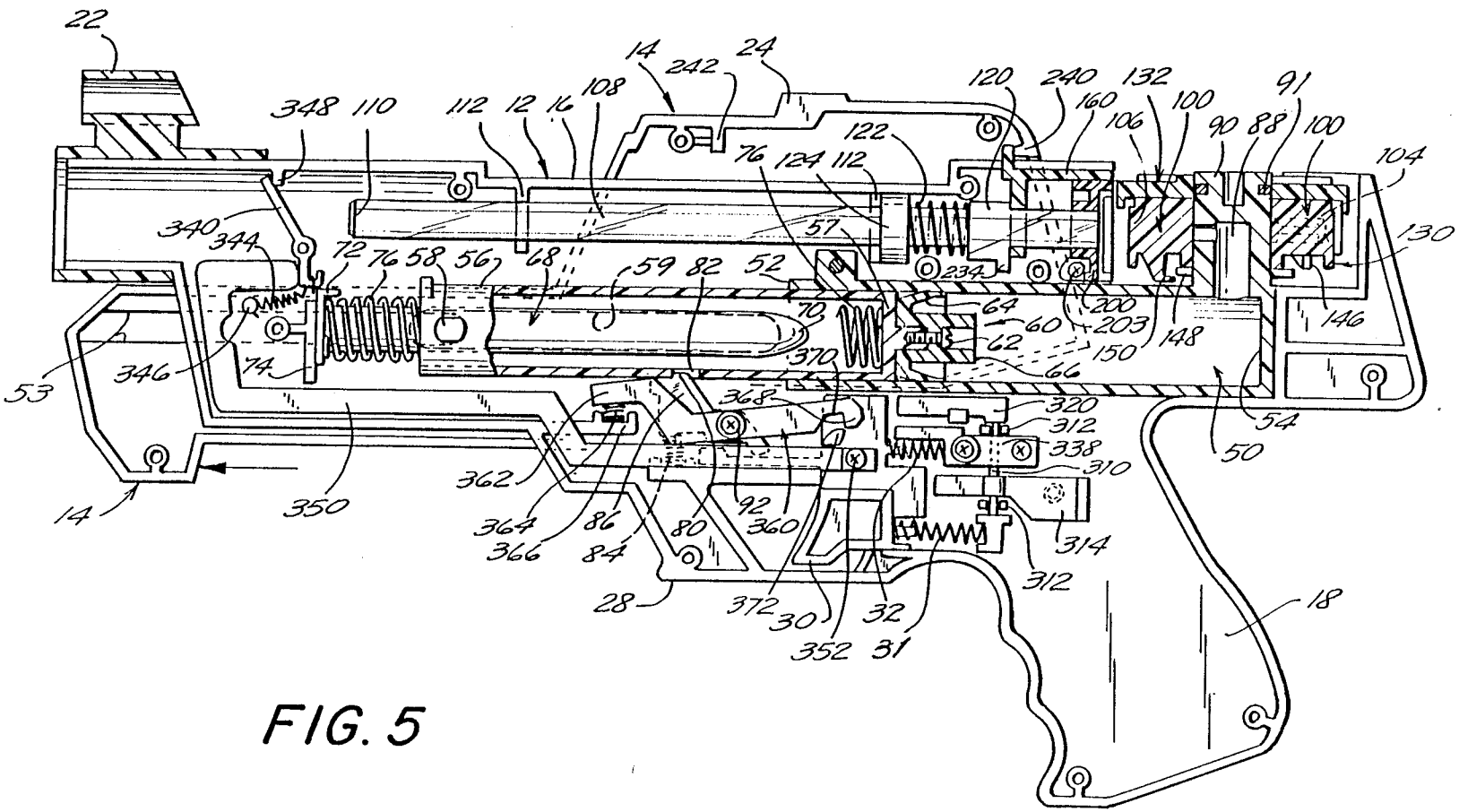
FIG. 5 is a view similar to FIG. 4, but with the parts shown in the position corresponding to FIG. 2.
Figure 6:
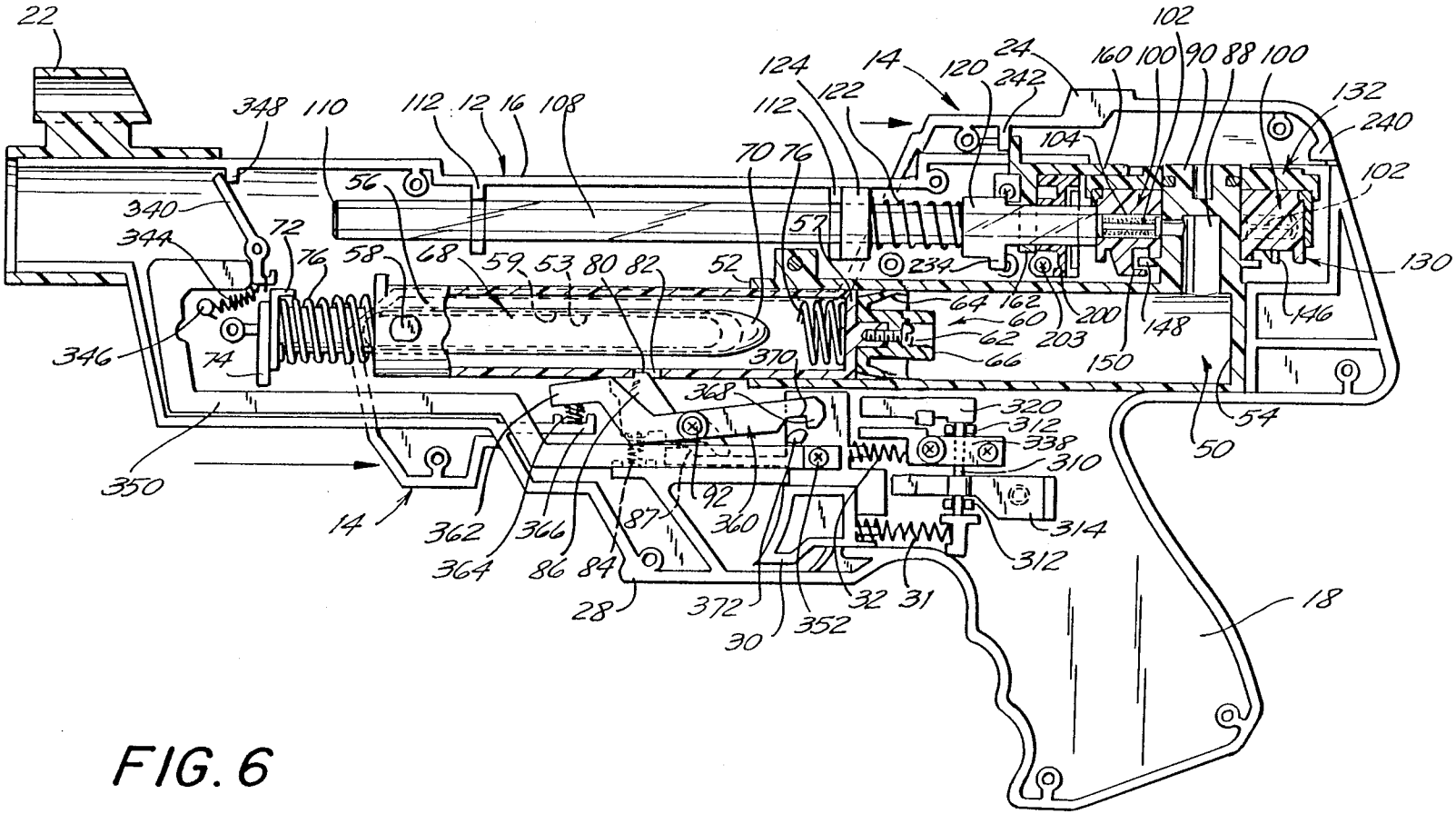
FIG. 6 is a view similar to FIG. 4, but with the parts shown in the position corresponding to FIG. 3.
Figure 7:
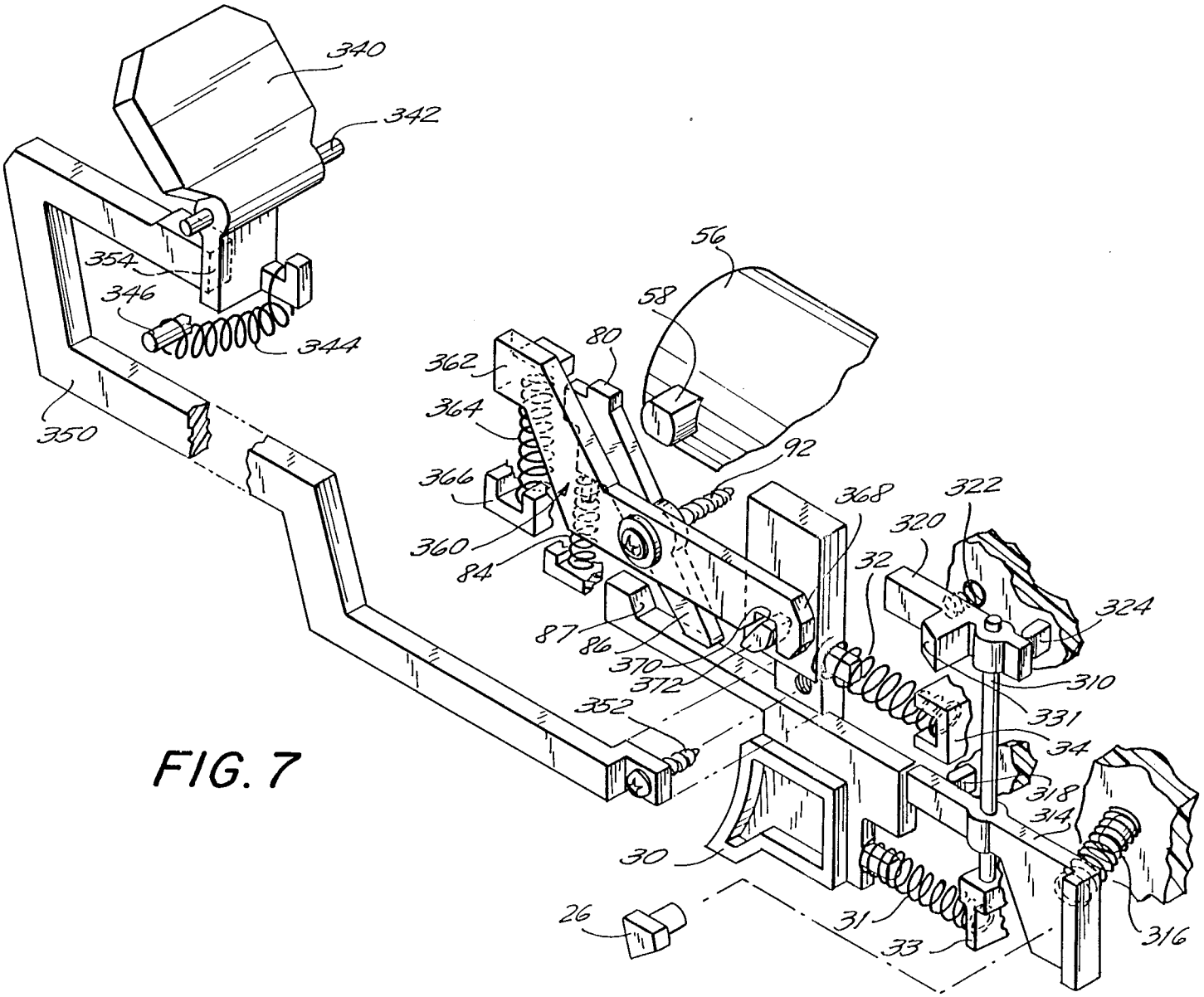
FIG. 7 is a fragmentary exploded isometric view of selected parts of the gun.

Referring now in particular to FIGS. 4–6, within the housing 12 is a fixed hollow cylinder, generally designated 50 extending parallel to barrel 16 and having an open forward end 52 and a closed rear wall 54. A hollow piston 56 is partially disposed within the cylinder 50. The forward end of the piston 56 projects through the forward end 52 of the cylinder and carries a pair of lugs 58 which extend laterally through longitudinal slots 59 in the barrel 16 of housing 12 and are engagingly received in sturdy grooves 53 in the inner surface of the stock 14. Upon movement of the stock 14 to the cocked position, the rear ends of the sturdy grooves carry the piston forwardly 56 to the cocked position as well, although the grooves are of sufficient length that the stock 14 may be returned back to its firing position without the front end displacing the piston 56 from its cocked position. A sealing member, generally designated 60, is secured to the rear wall 57 of the piston 56, within the cylinder 50, by a screw 62. The outer edges 64 of the sealing member 60 resiliently engage the inner walls of the cylinder 50 in a gas-tight connection, and the rear end 66 of the sealing member 60 limits the rearward motion of the piston 56 within the cylinder 50 and cushions its impact against the cylinder rear wall 54. A longitudinally-extending tubular guide member generally designated 68 has its rear end 70 disposed within the piston 56 and its front wall 72 bearing on a boss 74 of the housing. A longitudinally-extending compression spring 76 has a rear end bearing on the front surface of the back wall 57 of the piston 56 and a front end bearing against the rear surface of the guide member front end 72. The spring 76 surrounds the guide member 68 and is maintained in appropriate position thereby.

During the cocking operation, as the piston 56 is moved forwardly by stock 14 from the position shown in FIG. 4 to the position shown in FIG. 5, the piston rear wall 57 compresses the spring 76 against the guide member rear wall 72 and, simultaneously, draws the sealing member 60 forwardly within the chamber 50. When the piston 56 reaches its fully cocked position, as illustrated in FIG. 6, a detent 80 biased upwardly towards the piston sidewall by a spring 84 enters an aperture 82 in the piston sidewall and locks the piston 56 in its cocked position by precluding rearward motion thereof. The detent 80 is carried by the upper and forward end of an arm 86 mounted at a central point by screw 92 to the housing 12, the lower and back end of the arm being engageable by a surface 87 of the trigger 30 so that, when the trigger 30 is moved to its firing position, the arm 86 is rotated counterclockwise against the bias of spring 84 so that the detent 80 retreats from piston sidewall aperture 82, thereby allowing the spring 76 to drive the piston 56 and the sealing means 60 rearwardly together as a unit towards the cylinder rear wall 54. This has the effect of compressing and increasing the velocity the air within the cylinder 50 and forcing it out of the cylinder 50 and into a passageway 88 communicating therewith adjacent the chamber rear wall 54. The air within cylinder 50 by the action of the piston/-sealing member unit 56/60 is driven into passageway 88 upwardly and then forwardly through the interior of post 90. The post 90 is typically of one-piece integral construction with the cylinder 50 and mounts an O-ring 91 adjacent the top thereof.

During use of the gun a magazine generally designated 100, containing projectiles generally designated 102 within respective projectile-containing chambers 104, is situated about post 90 so that the active chamber—that is, the chamber in the firing position—has its rear end closely adjacent and in fluid-tight communication with the front end of the passageway 88 and its front end closely adjacent and in fluid-tight communication with the rear end 106 of a barrel tube 108 disposed within the barrel 16. The barrel tube 108 extends over a substantial portion of the length of barrel 16, the forward end 110 of the barrel tube 108 being disposed adjacent the front of the barrel 16 and the length of the barrel 108 being supported by a pair of housing supports 112 in such a manner as to allow the barrel tube 108 to undergo reciprocal longitudinal translation—that is, movement back and forth along its longitudinal axis relative to the housing 12. Thus, when the trigger 30 is moved to its firing position to fire the gun, the air of chamber 50 travels through passageway 88 upwardly and forwardly, forces projectile 102 out of magazine chamber 104 and through tube 108 from the rear end 106 thereof and out the front end 110 thereof.

It will be appreciated that the barrel tube 108 includes an enlarged portion 120 disposed generally towards the rear thereof. A compression spring 122 has a rear end bearing rearwardly against the large portion 120 to bias the same to the rear and a front end which abuts against a washer 124 through which the tube 108 can slide longitudinally, the washer 124 being blocked against forward motion by the rearmost housing boss 112. Thus the effect of the spring 122 is in part to maintain the rear end 106 of tube 108 closely adjacent to and in fluid-tight communication with the forward most surface of the magazine 100.

Figures 8, 9:
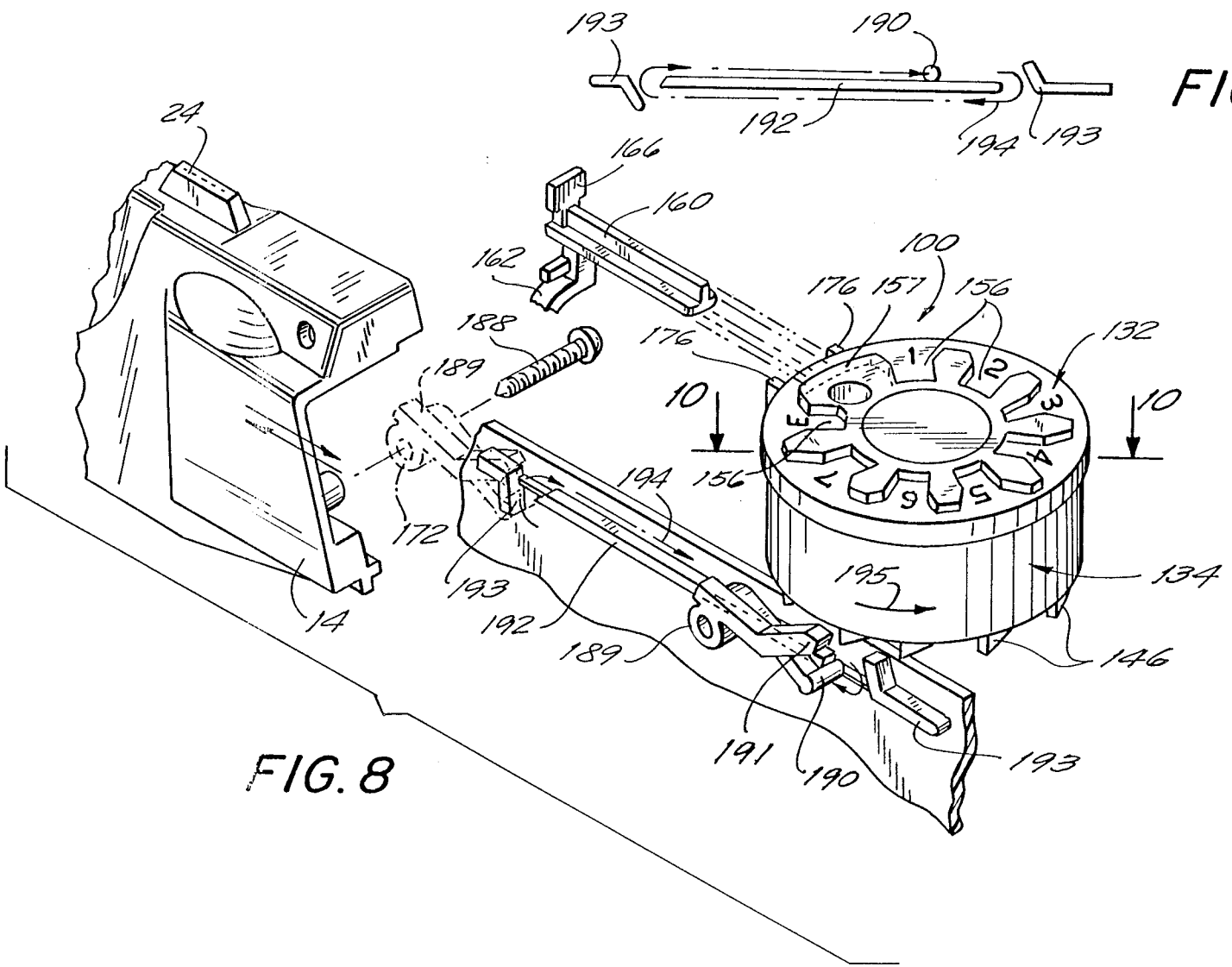
FIG. 8 is a fragmentary exploded isometric view of other selected portions of the gun.
FIG. 9 is a schematic view illustrating the camming action of a portion of the stock on the housing.
Figure 10:
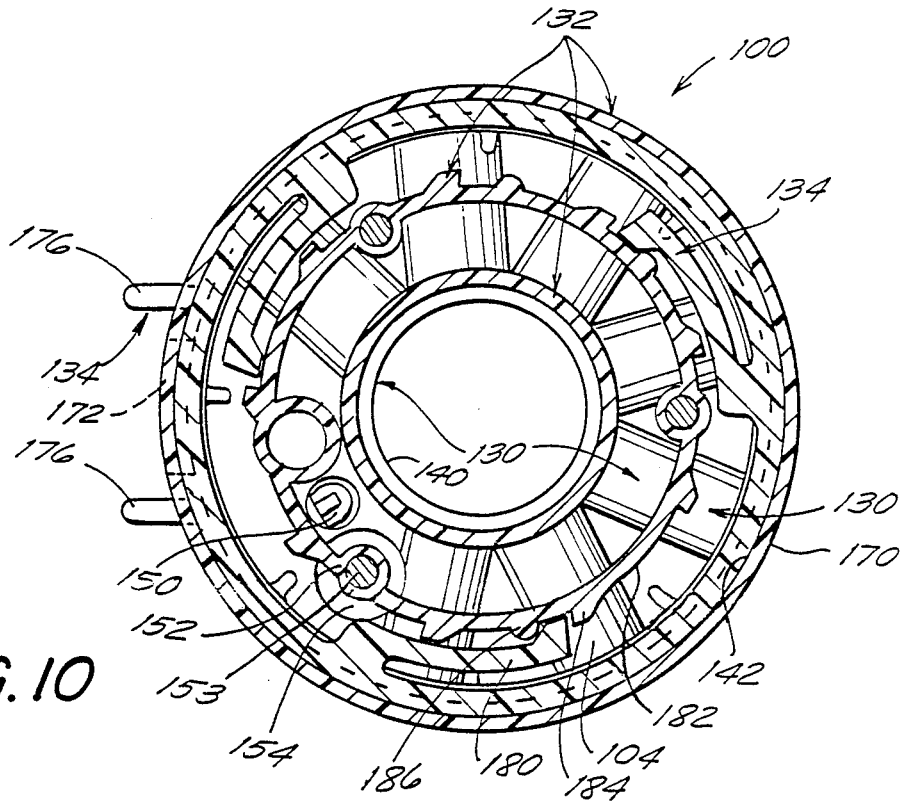
FIG. 10 is a top plan view of the projectile-containing magazine adapted for use with the gun, partially in section, taken along the line 10—10 of FIG. 8.
Figure 11:
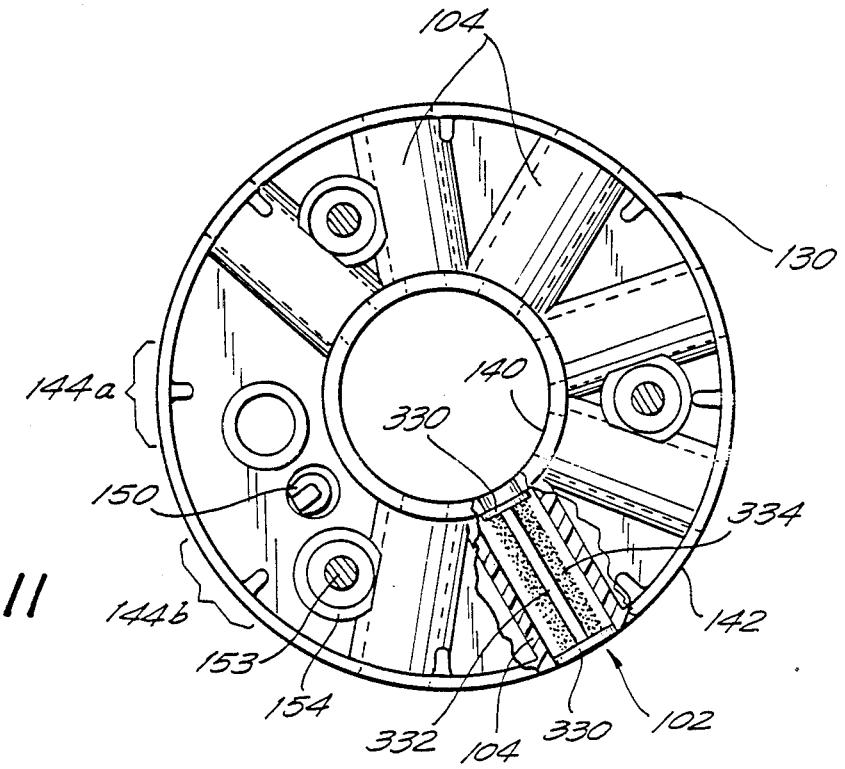
FIG. 11 is a top plan view, partially in section, of a rotatable carousel component of the magazine.
Figure 23:
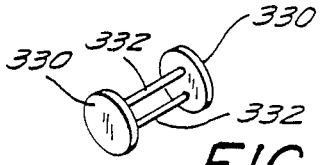
FIG. 23 is an isometric view of the indicator-carrier.
Figure 12:
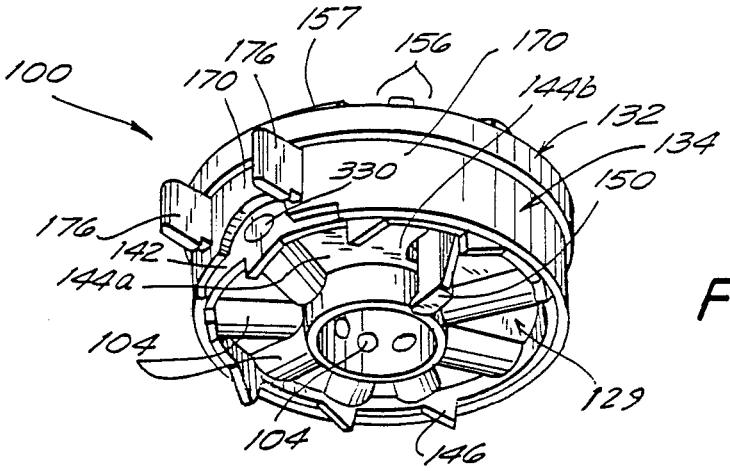
FIG. 12 is an isometric view of the magazine, to a somewhat reduced scale.

Now that the "power train" of the gun has been described, we will now turn in greater detail to the projectile-containing magazine 100 and the elements which interact therewith. Referring now to FIGS. 8–12 in particular, the magazine 100 is composed of three basic components: a projectile-carrying carousel generally designated 130 (the top of which is shown in FIG. 11 and the bottom of which is shown in FIG. 12), a cover generally designated 132 (the top of which is shown in FIG. 8 and the bottom of which is shown in FIG. 10), and a lug-carrying stator generally designated 134 (the outer sidewall surface of which is shown in FIGS. 8 and 12 and the inner sidewall surface of which is shown in FIG. 10).

More particularly, the carousel 130 is an annular member defining an inner circumference 140 and an outer circumference 142, and nine consecutive radially-extending sectors extending therebetween. The nine sectors consist of seven consecutive numbered hollow chambers 104, each connecting the inner and outer circumferences 140, 142 for the housing of a single projectile 102, and two consecutive non-chamber sectors 144, the various sectors being disposed like wheel spokes and equally spaced apart. The two sectors 144 are an unmarked "safety" sector **144*a*, which is exposed during loading of the magazine 100 into the gun and is disposed just before the first of the chambers 104, and an ""empty" sector 144*b*, which is exposed during removal of the magazine 100 from the gun and is disposed just after the last of the chambers 104 (see FIG. 11). The upper surface of the cover identifies each of the chambers 104 by a digit "1" through "7" and the "empty" sector 144*b* by the letter "E" (for "empty"), the "safety" sector 144*a* being unmarked (see FIG. 8). Each chamber 104 is of constant diameter except that the aperture on the inner circumference 140 is slightly less than the aperture on the outer circumference 142**.

The bottom surface of the outer circumference 142 defines downwardly projecting teeth 146 (see FIG. 12) equally spaced around the circumference except that one of the teeth 146 is missing. There are 8 teeth in all so that the "safety" sector **144*a* (in the firing position during loading of the magazine into the gun), each of the seven projectile-containing chambers 104, and the "empty" sector 144*b* may in turn be brought into firing position—that is, functionally aligned with the passageway 88 and tube 108. Thus, the carousel 130 is eventually rotated or indexed 320 degrees from a "safety" position to an "empty" position, where in both the initial and terminal positions there is no chamber 104 in the firing position. Furthermore, for reasons to be explained hereinafter, the absence of one tooth 146 ensures that once "empty" sector 144*b* of the magazine is in the firing position, the magazine 100** can no longer be indexed and must be removed before another projectile can be fired. One result of this is that a projectile passed over by successive cocking of the gun, without intermediate firing of the projectile, is lost and can never be fired.

The carousel 130 interacts with an outwardly-extending circumferential flange 148 adjacent the base of post 90 in two respects. First, the post flange 148 limits the downward movement of the main body of magazine 100 on the post 90 to insure that the chambers 104 are aligned at the horizontal level with the exit of passageway 88 and the rear or entry end of barrel tube 108. Second, a retaining element 150 depending from the lower surface of the carousel 130 (see FIG. 12) initially passes thorugh a gap in the outer flange 148 as the magazine 100 is being inserted on the post 90, and then, as the carousel 130 is indexed, the retaining element 150 is locked beneath the flange 148. This maintains the bottom of magazine 100 flush against the top of post flange 148 to ensure appropriate horizontal alignment of the magazine 100 and also precludes removal of the magazine 100 from post 90 (see FIG. 6) until it has been indexed almost a complete cycle from "safety" sector **144*a* in the firing position to "empty" sector 144*b*** in the firing position.

The cover, generally designated 132, contains three hollow bosses 152 extending downwardly to receive therein three engaging upwardly-extending boss-entering pins 153 of the carousel and to receive thereabout three engaging upwardly-extending boss-surrounding hollow cylinders 154, all to secure the top 132 and carousel 130 together for horizontal rotation as a unit. The upper surface of the top 132 defines eight horizontal openings or radial slots 156 for receiving the rear end of an aligning and stabilizing member 160, one slot 156 over each of the seven chambers 104 and "empty" sector 144*b*, and a blocking ridge 157 over the "safety" sector 144*a*. As will be explained hereinafter, these slots 156 are entered into by the stabilizing and aligning element 160 to ensure that the top/carousel 132/130 unit is in an appropriate position for proper alignment of the chambers 104 (identified by a digit "1" through "7") with the passageway 88 and barrel tube 108 and in an appropriate position for passage of the retaining element 150 through the gap in the post flange 148 in the case of the "empty" sector 144*b* (identified by the letter "E").

Figure 15:
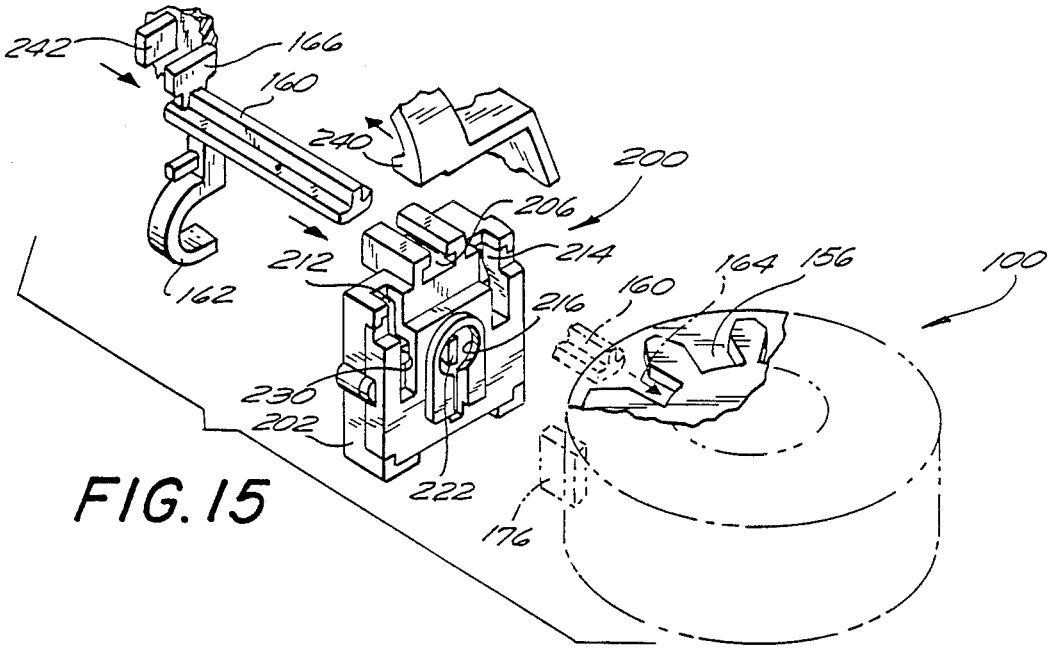
FIG. 15 is a fragmentary exploded isometric view of the barrel block and related components of the gun.
Figure 17:
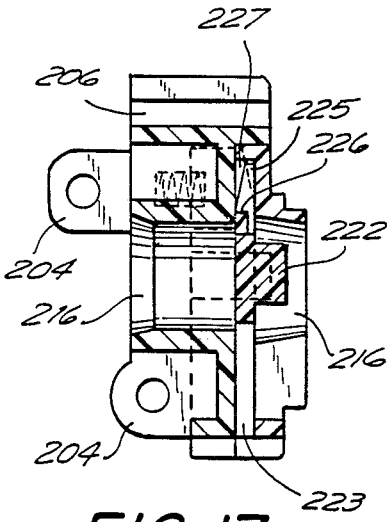
FIG. 17 is a side elevation view of the block taken along the line 17—17 in FIG. 16.
Figure 16:
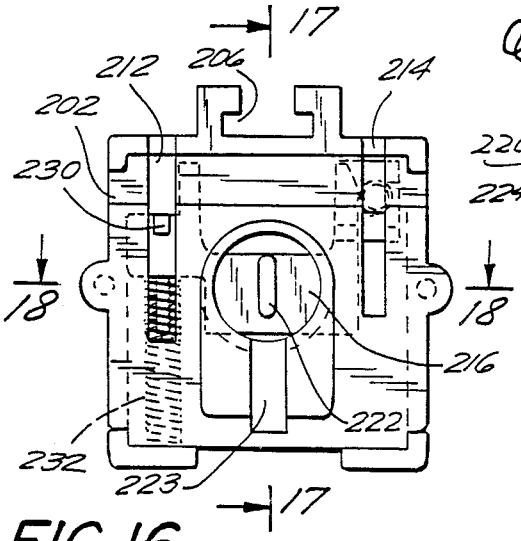
FIG. 16 is a rear elevation view of the block, to an enlarged scale.
Figure 19:
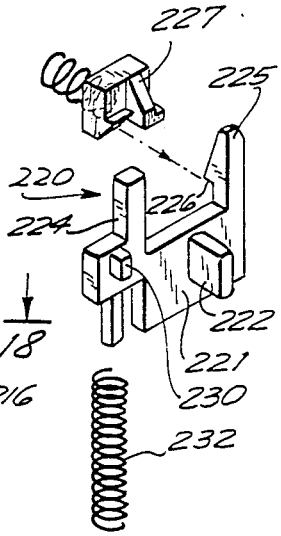
FIG. 19 is an exploded isometric view of the moving parts of the block.
Figure 18:
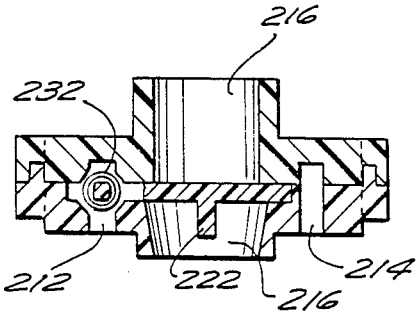
FIG. 18 is a top elevation view of the block taken along the line 18—18 of FIG. 16.

Referring now to FIGS. 8 and 15, the aligning and stabilizing means 160 is mounted on a rear portion of the barrel tube 108 by means of a depending hook portion 162 enabling reciprocal translation motion of the aligning and stabilizing means 160 along the longitudinal axis of the barrel tube 108. The rear end of the aligning and stabilizing means 160 enters in turn into a given slot (as shown in phantom line and the arrow 164 in FIG. 15) to ensure perfect alignment of a chamber 104 with both the passageway 88 and the barrel tube end 106. The aligning and stabilizing means 160 further includes a raised post or abutment surface 166 by means of which the stock 14 moves the aligning and stabilizing means 160 forwards and rearwards, forwardly out of engagement with the slots 156 during the cocking operation and rearwardly into engagement therewith after the magazine 100 has been indexed and the stock 14 is moved to the firing position.

The stator 134 is an annular member constituting the outer sidewall 170 of the magazine 100 and defining a notch or opening 172 through which only one of the sectors 104, 144 is exposed at a given time. Thus, when the magazine 100 is loaded into the gun, "safety" sector 144*a* is aligned with the notch 172 and subsequent indexing of the magazine 100 (that is, rotation of the top 132 and the carousel 130 relative to the stator 134) successively brings the seven numbered projectile-containing chambers 104 "1" through "7" and then the "empty" sector 144*b* into alignment with the notch 172. The stator 134 further defines a pair of outwardly projecting parallel lugs 176, the full function of which will only become apparent hereinafter, but which serve to immobilize the stator 134 through their engagement with other portions of the gun, so that indexing of the magazine 100 is effective to cause relative motion between the carousel/cover unit 130/132 and stator 134. Additionally, the inner surface of the stator 134 defines three resilient pawls 180 which bear inwardly against a depending coaxial inner rim 182 of the top 132. The inner rim 182 is provided with sharply outwardly projecting locking surfaces 184, which engage with the pawls 180 to preclude rotation of the carousel 130 in the clockwise direction relative to the stator 134, and softly rounded outwardly projecting surfaces 186, which engage with the pawls 180 to assist in appropriate positioning of the carousel 130 and strongly resist manual counterclockwise rotation thereof relative to the stator 134 while still permitting counterclockwise indexing to be performed by the stock 14. It will be appreciated that the projections 184, 186 and the aligning means 160 serve certain similar functions.

Indexing of the magazine 100 (that is, indexing of the carousel/cover unit 130/132 relative to the stator 134) occurs after cocking as the stock 14 is moving to its firing position. Secured to an inner surface of the stock 14 by a screw 188 is a one-piece integral unit 189 comprising an inwardly-extending lower cam follower 190 and an inwardly-extending upper indexing pawl 191 in a resiliently fixed relative spatial orientation. The cam follower 190 travels about a cam 192 on the inner surface of the housing 12 adjacent the magazine 100, with a cam assisting element 193 on the housing adjacent each end of the cam 192 to assist in maintaining the cam follower 190 in close contact with the cam 192. As illustrated in FIG. 9 by the arrow 194, the cam follower 190 during the cocking operation travels the full length of the bottom of the cam 192 until, at the end of the cocking operation, it is forced upwardly by the cam assisting element 193 adjacent the front of the cam 192. Then, as the stock 14 is moved rearwardly from the cocking position to the firing position, the cam follower 190 traverses the full length of the top of cam 192. Just before it reaches the firing position, the cam assisting element 193 at the rear of the cam 192 forces the cam follower 190 downwardly. Guide grooves (not shown) on the inner surface of the stock 14 determine the extent to which the cam follower 190 may travel upwardly above the upper surface or downwardly below the lower surface of the cam 192, thereby ensuring that the cam follower 190 is always engaged at either end of its travel by a cam assisting element 193.

As the cam follower 190 and indexing pawl 191 comprise a single one-piece element 189 composed of resilient material, the indexing pawl 191 travels a path determined in large part by the cam follower 190. As the stock 14 travels from the cocked position to the firing position, the indexing pawl 191 engages a tooth 146 of the magazine 100, causing the tooth 146 and thus the carousel/cover unit 130/132 to index counterclockwise (as shown by arrow 195 of FIG. 8) so as to bring a successive chamber or non-chamber into the firing position. The exception to this rule occurs when the "empty" non-chamber marked "E" is in the firing position, as in this instance the sector of the bottom of the carousel 130 characterized by an absence of a tooth 146 is disposed in the position which would normally be contacted by the indexing pawl 191. The subsequent transfer of the cam follower 190 from the upper surface of the cam 192 to the lower surface thereof, under the guidance of rear cam assisting element 193, lowers the height of the indexing pawl 191 below the bottom level of the teeth 146 of the carousel 130 so that the indexing pawl 191 clears the teeth 146 during its traverse forward as the stock 14 moves from the firing position to the cocked position.

Now that the magazine 100 and the means for indexing the same have been described in detail, we turn now to the barrel block, generally designed 200, with which it cooperates. Referring now to FIGS. 15–19 in particular, the barrel block 200 comprises a hollow housing 202 which is rigidly secured in position relative to the barrel 16 by abutting surfaces and by screws 203 (see FIG. 5) connecting block housing tabs 204 to the gun housing 12. The top of the barrel block housing 202 defines a keyway 206 which orients the aligning and stabilizing means 160 to insure that the chambers 104 of the magazine 100 are properly oriented in the firing position relative to the barrel tube 108 and passageway 88. The top and rear face of the barrel block housing 202 define a pair of left and right notches 212, 214 extending downwardly to about the middle of the barrel block housing 202. An aperture 216 extends throughout the barrel block housing 202 from the front face thereof through the rear face thereof. The aperture 216 at the front face of the barrel block 200 is aligned with and receives therewithin a rear portion of the barrel tube 108 while the rear of the aperture 216 tapers inwardly in the forward direction to centrally channel any slightly misaligned projectile.

Disposed within the hollow of the housing 202 of the barrel block 200 is a movable member 220. The movable member 220 includes a body portion 221 with a rearwardly projecting guide 222. The body portion 221 at least partially blocks the aperture 216 (and especially the travel path of the projectile) when the movable member 220 is in its raised blocking position and is disposed below the aperture 216 (and especially the travel path of the projectile) when the movable member 220 is in its lowered or non-blocking position. During its vertical translation between the raised and lowered positions, the movable member 220 is guided by the action of the rearwardly projecting guide 222 within a vertically-extending groove 223 communicating from below with the aperture 216. When the movable member 220 moves to its lowered position, the rear end 106 of the barrel tube 108 is free to pass through the aperture 216 of the barrel block 200, under the influence of the spring 122 described hereinabove, and to bear against the front of magazine 100 in substantially fluid-tight communication. The movable member 220 includes left and right upstanding posts 224, 225, disposed inwardly of the notches 212, 214, which posts assist in maintaining the alignment of the movable member 220 within the barrel block housing 202. Additionally, the right post 225 has a forwardly and downwardly sloping front surface to define an abutment surface 226 therebelow. A horizontally-extending latch 227 is normally biased rearwardly to abut against abutment surface 226 and preclude downward movement of post 225, the latch 227 having a rearwardly and downwardly sloping surface disposed within the notch 214. A rearward projection 230 adjacent the left post 224 is slidably disposed within the notch 212. A vertically-oriented compression spring 232, disposed partially within the hollow of the block housing 202 and partially within the notch 212, bears upwardly on the left side of the movable member 220, thereby biasing the movable member 220 for movement from its lowered position to its raised position.

As a magazine 100 is being placed on post 90 within the gun housing 12, and more particularly as the retaining element 150 passes below the post flange 148, the right lug 176 enters the block notch 214 and causes the latch 227 to advance forwardly against its bias so that it no longer abuts abutment surface 226, thereby freeing the right post 224 for downward motion and simultaneously the left lug 176 enters the notch 212 and displaces the projection 230 downward against the upward bias of spring 232. As a result, the entire movable member 220 moves downward with the guide member 222 entering groove 223. Initially the barrel tube 108 only partially enters the aperture 216 as the abutment of the rear of the aligning and stabilizing means 160 against the front of the cover 132 where there is no slot 156, 157 (corresponding to the "safety" chamber) limits rearward movement of the hook portion 162 of the aligning and stabilizing means 160 and thus rearward movement of flange 234 of the enlarged portion 120. Cocking of the gun results in stock portion 240 catching on the abutment surface 166 of the aligning and stabilizing means 160 and driving it forwardly, thereby driving the barrel tube 108 forwardly as well. As long as the magazine 100 is still in place on post 90 with lugs 176 in notches 212, 214, however, the aperture 216 remains open. Thus, when the stock 14 is returned to its firing position, stock portion 242 catches on the abutment surface 166 to drive the aligning and stabilizing means 160 rearwardly. As the same motion also indexes the magazine 100 and brings a slot 156 of cover 132 into alignment or near alignment with the aligning and stabilizing means 160, the spring 122 can now drive the enlarged portion 120 of tube 108 rearwardly so that the rear end 106 of tube 108 passes totally through aperture 216 and bears against the front of magazine 100.

Each time the gun is cocked and returned to the firing position the aligning and stabilizing means 160 and barrel tube 108 go through the full cycle. After all projectiles have been expended and the gun is again cocked, the retaining element 150 is properly positioned relative to the post flange 148 so that the magazine 100 may be removed from the post 90. Upon removal of the magazine 100 from post 90, its left lug 176 no longer bears downwardly on the projection 230 within notch 212, so that the movable member 220, being upwardly biased by spring 232, returns to its original raised and blocking position. During the process of returning ot its original position, the forward surface of the right post 225 cams the latch 227 rearwardly until the latch 227 slips forwardly under the horizontal abutment surface 226 of the right post 225.

It will be appreciated that while the retaining element 150 and post flange 148 require the magazine 100 to be properly positioned to block the aperture 216, even if the magazine 100 were somehow removed, the movable member 220 would reposition itself to block the aperture 216 upon removal of the magazine lugs 176 from the barrel block notches 212, 214. It is partially for this reason that the tube 108 is moved forwardly during each cocking operation a sufficient distance to permit the return of movable member 220 to its original raised of blocking position. In addition, the forward motion of the tube 108 during each cocking operation enables the magazine 100 to index (or be loaded onto or removed from the past 90) without any deleterious wiping action between the rear end 106 of the tube 108 and the front of the carousel 130.

Having described the general structure and operation of the gun, we turn now to the safety features thereof. Referring now to FIG. 3, the first safety feature of the gun is the employment of a handle 18 of such circumference, preferably at least 8 centimeters in the area of the trigger 30 and safety button 26, that it is too large for the small hand of a child to handle, especially when one digit must be pressed against the safety button 26.

Referring now to FIGS. 4–7 and 20–21, to enable the trigger 30 to be moved rearwardly from its rest position to its firing position, two additional safety mechanisms must be overcome. A pivot rod 310 extends substantially vertically adjacent trigger 30, supported by housing bosses 312. Mounted at their center points for independent rotation about the rod 310 are two separate safety firing elements. First, the safety firing element 314 is an arm pivotably mounted at a central point thereof on rod 310, the safety firing element 314 being biased by a spring 316 into a position abutting housing boss 318 so that the forward end of the safety firing element 314 is aligned with a rear surface of the trigger 30 to preclude rearward movement of the trigger 30 to its firing position. The safety firing element 314 is disposed within the housing 12 so that inward movement of the safety button 26 causes the safety firing element 314 to pivot counterclockwise against the bias of spring 316 so that the forward end of the safety firing element 314 and the rear surface of the trigger 30 are no longer aligned and safety element 314 no longer blocks the movement of trigger 30 to its firing position (see FIG. 20). A safety button which can be locked or latched in an enabling position is of little value when the gun is in the hands of those who would just as soon carry the gun with the safety in the enabling position. Thus the present invention provides no such locking or latching means and require that the safety button 26 actually be depressed as the trigger 30 is being pulled to its firing position.

Second, the safety firing element 320 is also an arm pivotably mounted at a central point thereof on the rod 310, the safety firing element 320 being biased by the spring 322 into a position abutting housing boss 324 so that a forward end of the safety firing element 320 is aligned with a rear surface of the trigger 30 to preclude rearward movement of the trigger 30 to its firing position. The stock 14 has a rear surface defining a rearwardly projecting detent 326 (see FIG. 2) which is adapted to enter a pocket 328 of the housing 12 as the stock 14 is moved from its cocked position into its firing position (FIG. 3). As the detent 326 enters the pocket 328, it engages and depresses the bevelled surface 331 of the safety firing element 320, causing the latter to pivot clockwise to a position wherein the forward surface of the safety firing element 320 and the rear surface of the trigger 30 are no longer aligned and thus the safety firing element 320 does not preclude movement of the trigger 30 to its firing position (see FIG. 21). A relatively slight motion of the stock 14 in the forward direction (as shown in FIG. 1) suffices to enable return of the safety firing element 320 under the influence of spring 322 to its normal blocking position abutting housing boss 324. Thus, safety firing element 320 ensures that the gun cannot be fired unless the stock 14 is in the firing position, thereby closing the housing opening through which the magazine 100 is inserted or removed and ensuring that there will be no splash back of dye or paint from the projectile onto the user. An aligning member 338 fixed to the housing maintains trigger 30 in appropriate lateral alignment with safety firing elements 314 and 320.

The fourth safety mechanism of the present invention is a front blocking means 340 disposed in the barrel 16 slightly forwardly of the front end 110 of the barrel tube 108. The front blocking means 340 is mounted for pivotal rotation on a rod 342 journaled into the housing 12. An extension spring 344 secured one end to a housing boss 346 and at the other end to the front blocking means 340 biases the front blocking means 340 in a clockwise direction to a position abutting housing boss 348 (see FIGS. 4–7) wherein the front blocking means 340 blocks the forward end 110 of the barrel tube 108 and traverses the travel path of any projectile fired by the gun. A J-shaped connecting member 350 is secured to the trigger 30 by a screw 352 at one end and has its free end 354 abutting a front surface of front blocking means 340 below the pivot rod 342. Movement of the trigger 30 rearwardly towards its firing position also moves the rearwardly-facing free end 354 of the J-shaped member 350 to press against the front surface of the blocking means 340 so that the front blocking means 340 pivots counterclockwise against the bias of spring 344, thereby to expose the front end 110 of the barrel tube 108 and remove itself from the travel path of the projectile (see FIGS. 20–21).

To prevent the user from bypassing the front blocking means 340 simply by activating the safety mechanisms 314 and 320 (i.e., by pressing the safety button 26 and having the stock in the firing position, respectively) so that the user can hold the trigger 30 in its firing position while inserting unintended projectiles into the front end 110 of the barrel tube 108, a trigger lock generally designated 360 is provided to lock the trigger 30 against movement towards its firing position unless the gun is cocked.

The trigger lock 360 within the housing 12 is pivotally mounted at a central point thereof to the housing by screw 92. The lock 360 has a forward end 362 biased upwardly by a compression spring 364 mounted on a housing boss 366 and a rear end 368 having a downwardly opening notch 370 adapted to receive and block rearward movement of a lateral projection 372 on the trigger 30. The upward biasing of the spring 364 against the front end 362 of the lock 360 causes the lock to pivot clockwise with the rear end 368 traveling downwardly and causing notch 370 to engage the trigger projection 372 and block its rearward movement. As the gun is cocked, however, the forward travel of the piston 56 causes the lock forward end 362 to depress against the bias of spring 364, thereby pivoting the lock 360 counterclockwise and raising the notch 370 from the trigger projection 372, to free the trigger 30 for rearward motion towards its firing position.

Thus, the gun is relatively safe against insertion of unintended projectiles into the front end 110 of the barrel tube 108 except for the brief interval after the gun has been fired and before the trigger 30 has been released. The rear end 106 of the barrel tube 108 is also protected against the insertion of unintended projectiles since, as described hereinabove, the movable member 220 blocks the aperture 216 of barrel block 200 unless a magazine 100 is in place with the lugs 176 in the notches 212, 214, the magazine 100 in effect then blocking access to aperture 216. If the stock 14 is in a sufficiently forward position to allow movement of the magazine 100 on and off the post 90, the barrel tube 108 is sufficiently spaced forwardly from the front of the barrel block 200 that any removal of lugs 176 of the magazine 100 from the notches 212, 214 of the barrel block 200 results in the movable member 220 closing the aperture 216, thereby precluding the insertion of an unintended projectile into the rear of the barrel tube 108.

The magazine 100 itself contains various safety features designed to discourage the substitution of unintended projectiles for the intended projectiles. The "safety" sector **144*a* exposed through the notch 172 when the magazine 100 is being mounted on the post 90 and the "empty" sector 144*b* exposed through the notch 172 when the magazine is removed from the post 90 are not hollow like the chambers 104 and thus cannot be filled with a projectile. The retaining element 150, in cooperation with the post flange 148, ensures that only these two sectors 144 will be exposed to the user, and not one of the chambers 104. The very strong engagement of the pawls 180 with the detents 184 and 186 make it very difficult, if not impossible under ordinary circumstances, to manually rotate the carousel 130 relative to the stator 134 so as to bring chambers 104 into alignment with the notch 172**.

Even if the opening in the post flange 148 were enlarged or the retaining element 150 of the magazine 100 were removed, so that the magazine 100 could be removed from the post 90 (after a projectile 102 had been fired) with an empty chamber 104 aligned with notch 172 and available for refilling with a simulated or counterfeit projectile, the simulated projectile could still not be fired. Once the magazine 100 with the simulated projectile was re-mounted on post 90, the gun could not be fired until the stock 14 was returned to its firing position closing the open top of the housing 12. However movement of the stock 14 from the cocking position to the firing position automatically causes indexing of the magazine 100 (except where empty chamber **144*b* is in the firing position) so that the chamber 104 containing the simulated projectile would be rotated out of the firing position. Thus, the simulated projectile could not be fired. Because the magazine 100 contains mechanisms precluding rotation of the carousel 130 in a reverse direction relative to the indexing direction), the magazine cannot be pre-set to avoid this safety feature. And because the magazine cannot be indexed by the gun from the empty chamber 144*b* to the safety chamber 144*a*, this safety mechanism cannot be defeated by repeated cocking of the gun intended to bring the desired chamber 104 containing the simulated projectile into the firing position. Thus the "disposable", or more accurately "non-re-usable", nature of the magazine 100 defeats attempts to introduce simulated or counterfeit projectiles via the magazine 100 just as the front blocking means 340 and barrel block 200 preclude the introduction of simulated projectiles through the front end and rear end, respectively, of the barrel tube 108**.

Figure 22:
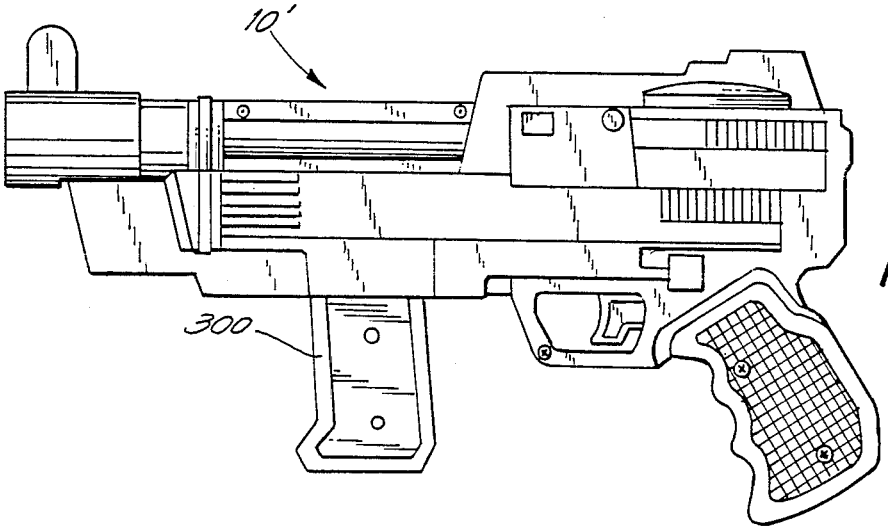
FIG. 22 is a side elevation view of a second embodiment of the present invention.

Referring now to FIG. 22, therein illustrated is a second embodiment of the present invention, generally designated 10'. The differences between the first and second embodiments 10 and 10' are essentially cosmetic, the primary functional difference being the provision of a front hand grip 300 depending from the base of the stock to permit a more secure and leveraged manual grasp on the stock to facilitate its translation between the cocking and firing positions.

To operate gun 10, the user holds the handle 18 in one hand 20 and stock 14 (or in the case of gun 10', stock 300) in the other hand 21 and pulls them in opposite directions, as shown by arrows 35, 36, until gun 10 is in the cocked position illustrated in FIGS. 2 and 5. During the cocking operation, stock 14 carries forwardly with it the piston lugs 58 projecting through longitudinal side slots 59 of barrel 16 for movement into the cocked position with stock 14. The movement of the piston lugs 58 carries with it piston/sealing member unit 56/60, compressing the spring 76 against front wall 72 of guide member 68. The caming action of piston 56 on trigger lock 360 causes the latter to rotate counterclockwise against the influence of spring 364 until notch 370 is lifted from trigger boss 372, thereby relieving the trigger 30 from one constraint against movement to its firing position.

Referring now to FIG. 9, during the cocking operation cam follower 190 travels the length of the undersurface of cam 192, maintaining indexing panel 191 below the level at which it might encounter the indexing teeth 146 of magazine 100 (if a magazine were in place on post 90). At the end of the cocking stroke, cam follower 190 is engaged by front cam assisting element 193, which deflects cam follower 190 upwardly so that, during subsequent travel of stock 14 to the firing position, the cam follower 190 travels on the upper surface of the cam 192 to maintain the indexing pawl 191 at an elevated level to engage an indexing tooth 146 of the magazine 100.

Once piston 56 reaches the cocked position, arm 86 rotates clockwise under the influence of spring 84 to cause detent 80 to enter piston aperture 82 and thereby lock piston 56 in its cocked position until trigger 30 is moved to its firing position. Cocking reveals the open top of housing 12 so that projectile-containing magazine 100 (with "safety" sector **144*a* being aligned with notch 172) may be inserted through the top of housing 12 and mounted on post 90, with retaining element 150 of magazine 100 passing through the gap in post flange 148 and the inner circumference of carousel 130 of magazine 100 being supported on post flange 148. As magazine lugs 176 enter notches 212, 214 of barrel block 200, the right lug cams latch 227 rearwardly to free movable number 220 for downward movement into its enabling position, while left lug 176 engages movable member projection 230 and forces movable member 220 downwardly against the upper bias of spring 232**.

Next the stock 14 and handle 18 are pushed together, in the direction of arrows 37 and 38, until stock 14 is in the firing position illustrated in FIGS. 3 and 6. Referring now to FIG. 9, as stock 14 moves to its firing position, cam follower 190 travels the upper surface of cam 192 and maintains indexing pawl 191 in an elevated position so that it engages one of the indexing teeth 146 at the base of the magazine 100 and rotates the carousel/cover unit 130/132 of magazine 100 sufficiently to bring the first chamber 104 (marked "1" on magazine cover 132) into the firing position. Further movement of stock 14 towards the firing position causes cam follower 190 to engage the rear cam assisting element 193 which deflects it downwardly, so that when cam follower 190 is next moved forwardly, it travels along the undersurface of cam 192.

Referring now to FIGS. 8 and 15, the same further movement of the stock 14 toward the firing position causes an interior boss thereof to engage upstanding abutment surface 166 of aligning and stabilizing member 160 so that aligning and stabilizing member 160 enters into the slot 156 marked "1" atop magazine cover 132, thereby to ensure appropriate lateral alignment of the slot 156 (and hence the underlying chamber 104 and projectile 102 therein) with the barrel tube 108. The rearward motion of aligning and stabilizing member 160, and in particular the hook portion 162 thereof, enables rear end 106 of barrel tube 108 to move rearwardly through barrel block housing aperture 216 under the influence of spring 122 until it forms a relatively air-tight seal with the magazine chamber 104 exposed through notch 172 of magazine stator 134.

Figure 20:
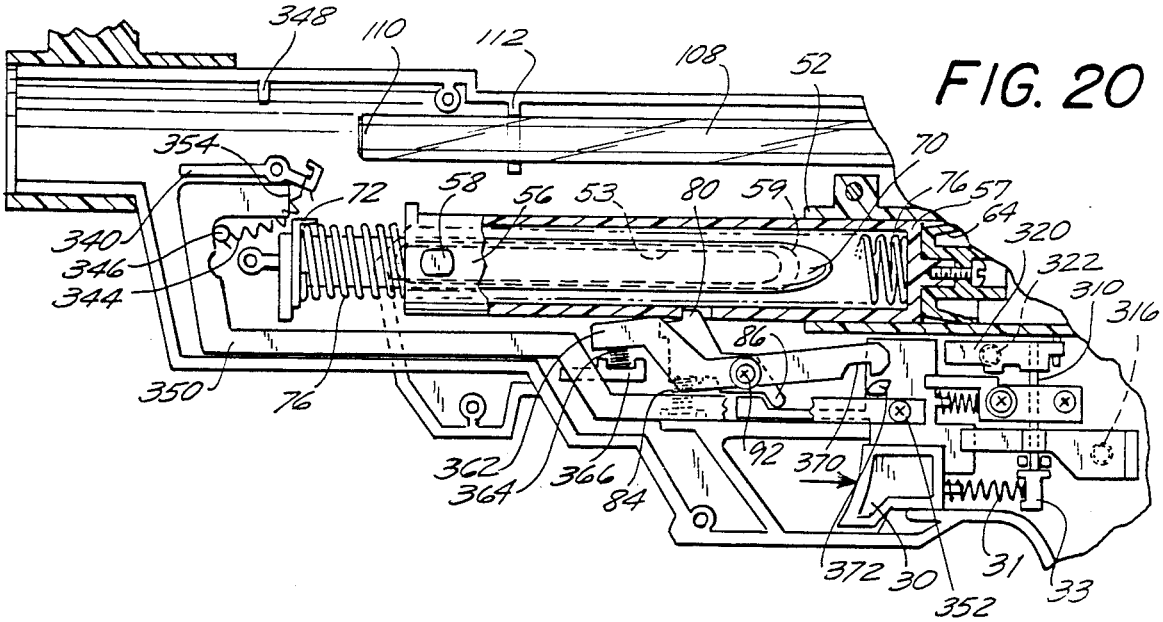
FIG. 20 is a fragmentary view similar to FIG. 4, but with the parts shown in the position where the trigger is partially moved to its firing position.

As the stock 14 moves into the firing position, the rearwardly projecting detent 326 of stock 14 enters the forwardly open pocket 328 of housing 12 (see FIG. 3) to cause the safety firing element 320 to pivot clockwise and bring its front surface out of alignment with the adjacent rear surface of trigger 30, thereby removing a second impediment to movement of trigger 30 to its firing position, as shown in FIG. 20. The safety button 26 (see FIG. 3) must be depressed to cause the safety firing element 314 to pivot counterclockwise and bring its forward surface out of alignment with the adjacent rear surface of trigger 30, thereby removing a third and final impediment to movement of trigger 30 to its firing position, as shown in FIG. 21.

Figure 21:
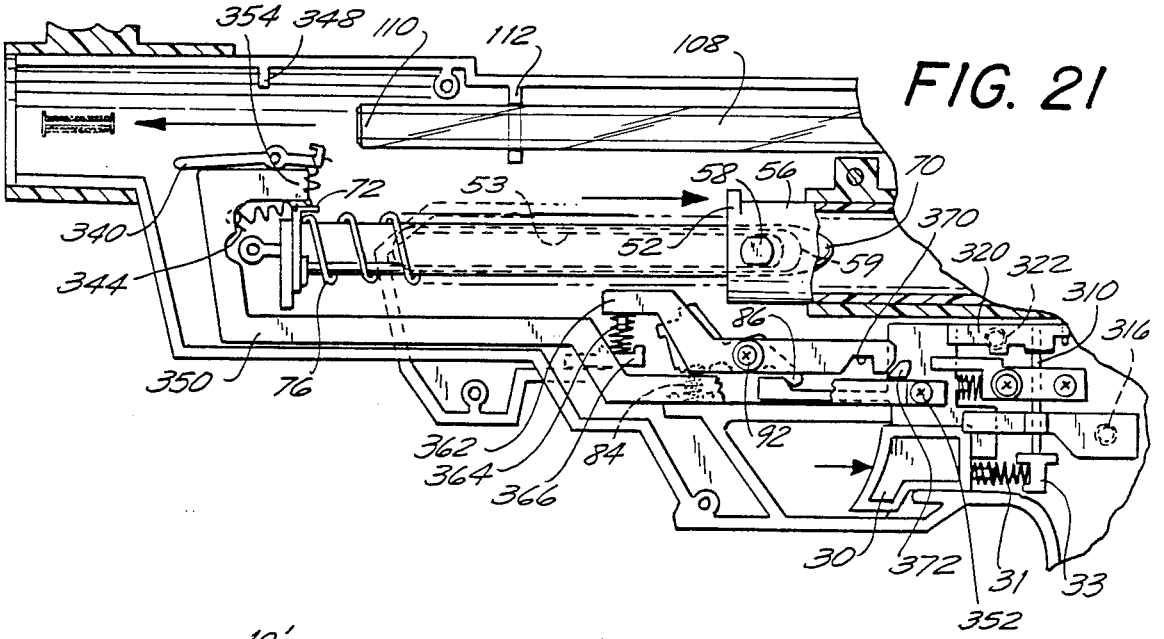
FIG. 21 is a fragmentary view similar to FIG. 4, but with the parts shown in the position where the trigger is in its firing position.

Referring now to FIGS. 20–21, as trigger 30 is moved rearwardly to its firing position, J-shaped connecting member 350 also travels rearwardly, its free end 354 causing front blocking means 340 to pivot in a counterclockwise direction about its pivot rod 342 against the influence of spring 344, thereby to displace front blocking means 340 from the travel path of the projectile 102. As trigger 30 reaches the firing position, arm 86 is cammed in a counterclockwise direction against the influence of spring 84 to withdraw detent 80 from piston aperture 82. This permits the compressed spring 76 to drive piston 56 and sealing element 60 rearwardly thereby compressing and accelerating air within cylinder chamber 50 and forcing the air through passageway 88 of post 90 and against the rear surface of projectile 102 in the firing position, that rear surface 330 being exposed through an aperture in inner circumference 140 of magazine 100 (as shown in FIG. 12). The air forces the projectile 102 out of chamber 104 through barrel tube 108, past front blocking means 240 and out of barrel 16 of housing 12.

Assuming that trigger 30 has been released, trigger 30 returns to its rest position under the influence of springs 31, 32. The front blocking means 240 simultaneously returns to its normal blocking position under the influence of spring 344, as the free end 354 of J-shaped member 350 is no longer active on front blocking number 340. As seen in FIG. 1, the retreat of piston 56 into cylinder 50 enables trigger lock 360 to pivot clockwise under the influence of spring 364 so that notch 370 again engages trigger boss 372 to preclude trigger movement. Assuming that safety button 26 is no longer depressed, safety firing element 314 pivots clockwise under the influence of spring 316 back into alignment with the adjacent rear surface of trigger 30 to resume its normal trigger-blocking activity. Finally, as stock 14 is moved slightly forwardly relative to housing 120, as shown in FIGS. 1 and 4, the stock detent 326 leaves housing pocket 328 so that safety firing element 320 pivots counterclockwise against the influence of spring 322 back into alignment with the adjacent rear surface of trigger 30 to resume its normal trigger-blocking activity.

As stock 14 continues its travel toward the cocked position, it displaces aligning and stabilizing means 160 from magazine slot 156, thereby freeing magazine 100 for further indexing.

After the cock and fire cycle is repeated seven times so that all seven projectiles in the seven chambers 104 have been fired, the next "cock and return to firing position" cycle brings "empty" sector **144*b* into the firing position. Additional cocking and firing of the gun will not result in further indexing of magazine 100 as there is no indexing tooth 146 within the travel path of indexing pawl 191. The retaining element 150 is maintained in a position vertically aligned within the gap of the post flange 148, so that magazine 100 may be removed from the post 90 and a fresh magazine 100 placed on post 90. Removal of the magazine 100 from post 90, and hence the removal of lugs 176 from notches 212, 214 of barrel block 200, enables the return of movable member 220 to its original raised position under the influence of spring 232, the upward movement of the movable member 220 causing the latch 227 to cam rearwardly until it is able to move into a locking position under the abutment surface 226 of post 225. It will be appreciated that movement of the stock 14 to the cocked position also causes the movement of barrel tube 108 forwardly (through the intermediate action of the aligning and stabilizing member 160) so that movable member 220 is free to move upwards within barrel block housing 202**.

In certain instances paint or dye from the projectiles will accumulate inside the barrel tube 108, especially adjacent the rear end 106 thereof, possibly from the barrel tube 108 wiping paint or dye from the projectile being fired therethrough. The various safety measures of the present invention greatly complicate the task of removing the accumulated debris from the barrel tube 108. The front blocking means 340 precludes the use of a cleaning rod inserted rearwardly into the barrel tube 108, and the blocking of the barrel block aperture 216 by the movable member 220 whenever the magazine 100 is removed from the post 90 precludes the use of a cleaning rod inserted forwardly through the barrel block 200. In order to overcome this difficulty, the present invention contemplates the use of a kit containing the gun 10 and a cleaning magazine.

Figure 13:
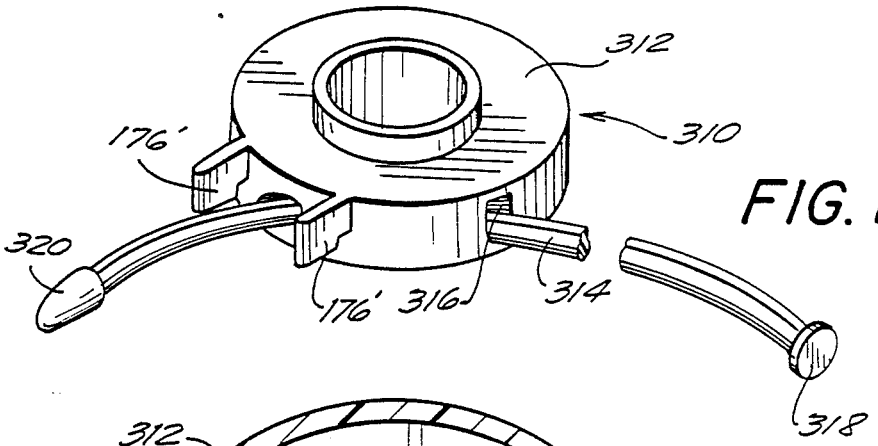
FIG. 13 is a fragmentary isometric view of a cleaning magazine adapted for use with the gun.
Figure 14:
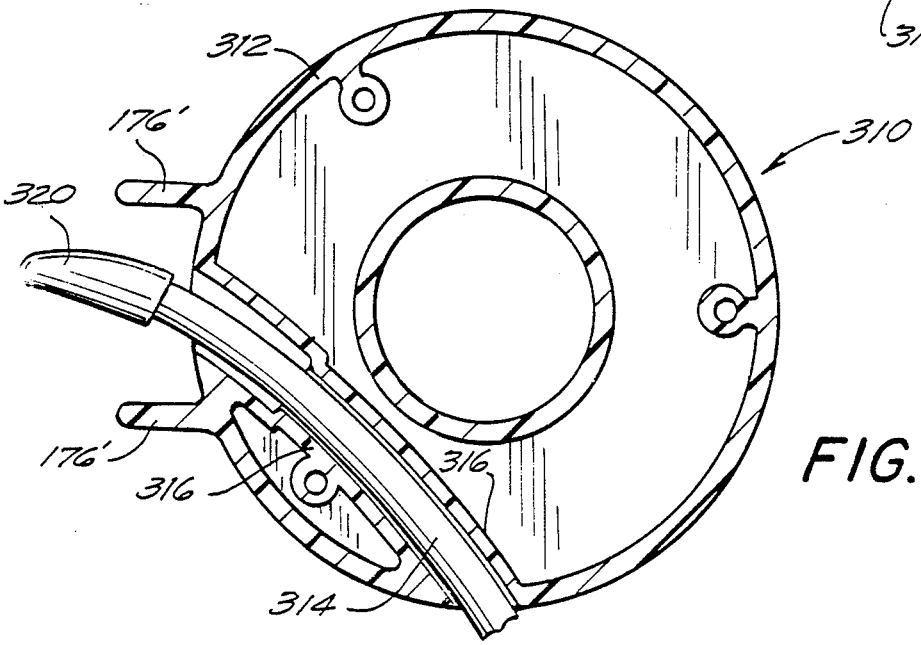
FIG. 14 is a fragmentary sectional view to an enlarged scale of the cleaning magazine.

Referring now to FIGS. 13 and 14, therein illustrated is a cleaning magazine, generally designated 310, consisting of a cylinder 312, generally mimicking the projectile-containing magazine 100 in essential aspects of its external appearance, and a flexible cleaning rod 314 passing through the cylinder 312 as an arcuate non-diametric chord. More particularly, the cylinder 312 is of annular design with a depending inner circumferential rim of sufficient height to position the cylinder at an appropriate level for horizontal alignment with the rear end 106 of the barrel tube 108. The cylinder 312 includes a pair of lugs 176' which function, in the manner of lugs 176 of the projectile-containing magazine 100, to open the barrel block 200 and thereby enable the rear end 106 of the barrel tube 108 to move closely adjacent to the cylinder 312 under the influence of spring 122. The inner circumference of the cylinder 312 is imperforate so that it cannot be adapted for use as a counterfeit or a simulated projectile-containing magazine 100. The interior of the magazine 312 defines a channel 316 through which the cleaning rod 314 passes, the front end of the channel 316 being disposed between the lugs 176'. The cleaning rod 314 has an enlarged head 318 at one end and an enlarged tapered nose 320 at the other end, the nose 320 and head 318 cooperating to preclude accidentally pulling of the rod 314 through the channel 316 sufficiently to separate the rod 314 from the cylinder 312. The channel 316 at its front end is of enlarged diameter to receive the nose 320 therein, although the remainder of the channel 316 is narrower so that the nose 320 cannot be passed therethrough.

To insert the cleaning magazine 310 in the gun, the cleaning rod 314 is pulled rearwardly until the nose 320 is buried within the forward enlarged diameter portion of the channel 316, and then the magazine 310 is inserted on the post 90 in the manner of a projectile-containing magazine 100. Once the cleaning magazine 310 is in place and the barrel block 200 is opened by lugs 176' so that the barrel tube rear end 106 bears on the cylinder 312, the cleaning rod 314 is grasped adjacent the head 318 and move forwardly so that the nose 320 enters the barrel tube 108. The length of the cleaning rod 314 is selected so that the entire length of the barrel tube 108 may be cleaned by the nose 320 as the cleaning rod 314 is reciprocated back and forth. Once the cleaning operation is completed, the cleaning rod 314 is withdrawn until the nose 320 again rests in the enlarged diameter portion of the channel 316, and the cleaning magazine 310 is then removed from the post 90 in a manner similar to removal of a projectile-containing magazine 100.

It will be appreciated that the gun described herein may be utilized in conjunction with a variety of different projectiles. For example, dye or paint filled gelatin capsules of the type used in prior art guns may be employed, the capsules being disposed within the chambers 104 of the projectile-containing magazine 100. In order to cause such capsules to burst efficiently upon hitting a target, however, it is necessary either to project the capsules with such force that they constitute a danger to persons hit by them or to use a sharp capsule-splitting mechanism adjacent the front end of the barrel, such a sharp mechanism posing an undesirable safety hazard. Accordingly, the preferred projectiles of the present invention are the soft, low velocity type disclosed in British patent application Ser. No. 8706198, filed Mar. 16, 1987 and U.S. patent application Ser. No. 168,689, filed Mar. 16, 1988 filed herewith.

Referring now to FIGS. 4, 6, 11 and 23, the projectile generally designated 102 is comprised of a parallel pair of axially spaced, opposed and generally aligned flat circular discs 330, a pair of longitudinal posts 332 secured to opposed faces of the discs 330 to connect the same, and a viscous gel-like indicator 334 disposed between the disc 330 and about the posts 332. The diameter of the rear disc 330 is about equal to the inner diameter of the barrel tube 108, and the combined cross-sectional areas of the posts 332 is substantially less than that of the rear disc 330. The front disc 330 is preferably of slightly greater diameter than the rear disc 330 and its edges wipe the inside of the barrel tube 108 to remove accumulated debris. The discs 330 and posts 332 form an indicator-carrier and are made of relatively soft plastic, with the posts 332 preferably being weaker than the discs 330 so that when the front disc 330 strikes a target surface, the posts 332 will buckle outwardly as the momentum of the rear disc 330 continues to carry it forwardly, thereby forcing the indicator 334 forwardly onto the target surface about the front disc 330.

The viscosity of the indicator 334 is selected to insure that, in conjunction with the discs 330 and posts 332, the semi-solid indicator will maintain a homogeneous mass during acceleration within the gun and in flight, yet it will be ejected therefrom when the forward motion of the front disc 330 is abruptly terminated. The viscosity of the indicator 334 and the diameter of the front disc 330 relative to the diameter of the chamber 104 containing the projectile 102 in combination assist in maintaining a projectile 102 in the chamber 104 against accidental dislodging once the chamber 104 is in the firing position and before the gun is actually fired. The indicator 334 may be an easily removable water-based paint or an indelible dye depending on the intended use of the gun (for example, whether the gun is used to temporarily tag people in a game or to permanently mark trees for conservation purposes).

As used in the present application, the terms "indicator," "paint," "dye" and the like encompass any gas, fluid, gel, semi-solid, or soft solid material that is used as a projectile in the gun.

To summarize the present invention provides a gun which compresses a spring during cocking and uses the air accelerated by the spring to propel a projectile during firing. The gun incorporates several safety features. The size of the handle makes it impossible for children to operate the gun. The trigger cannot be moved to its firing position unless the gun is cocked, the gun housing is closed (to prevent backfire on the user) and a manual safety button is actuated during firing. To prevent unintended projectiles from being inserted into the barrel, the front of the barrel is blocked except during firing, and the rear of the barrel is blocked at all times by either the projectile-carrying magazine or the barrel block. The gun utilizes a projectile-carrying magazine which resists loading with unintended simulated projectiles. The gun is of rugged and economical construction, yet easy to manufacture and maintain.

Now that the preferred embodiments of the present invention have shown and described in detail, various modifications and approvements thereon wil become readily apparent to those skilled in the art. Accordingly, the appended claims should be construed broadly in a manner consistent with the spirit and scope of the invention disclosed herein.

We claim:

1. A gun for projecting a projectile, comprising:

(A) a frame defining a handle for holding the gun and a barrel from which the projectile is projected;

(B) a trigger movable relative to said frame between a rest position and a firing position;

(C) means for removably receiving a projectile within said frame adjacent the rear end of said barrel;

(D) means for projecting the projectile through said barrel and out of said gun when said trigger is moved to said firing position;

(E) blocking means, disposed adjacent the front end of said barrel for preventing the insertion of objects into said barrel from the front thereof rearwardly of said blocking means, said blocking means being movable between an operative position, wherein said blocking means extends substantially across said barrel and in the travel path of the projectile, and an inoperative position, wherein said blocking means is spaced from the travel path of the projectile; and (F) means, operative in response to movement of said trigger between its rest position and its firing position, for moving said blocking means to its inoperative position when said trigger is in its firing position and to its operative position when said trigger is not in its firing position.

2. The gun of claim 1 wherein said blocking means is pivotally secured at one end to said frame for movement between its operative and inoperative positions.

3. The gun of claim 1 wherein said moving means includes means biasing said blocking means to its operative position, and is operative, in response to movement of said trigger from its firing position to its rest position, for enabling said biasing means to move said blocking means to its operative position.

4. The gun of claim 1 wherein the operative portion of said barrel forwardly of said blocking means is of greater cross section than the operative portion of said barrel rearwardly of said blocking means.

5. The gun of claim 1 wherein the distance between the rear of said handle and the front of said trigger in its rest position, in a horizontal plane passing through said trigger parallel to said barrel, is at least 8 centimeters, thereby to prevent simultaneous gripping of said handle and said trigger, and hence operation of the gun, by persons of small stature.

6. A gun for projecting a projectile, comprising:

(A) a housing defining a barrel and a handle in generally transverse relationship, said housing defining an aperture to permit placement of the projectile within the housing;

(B) a trigger movable relative to said housing between a rest position and a firing position;

(C) a first safety firing means disposed on said handle, said first safety firing means being movable between an enabling position, enabling movement of said trigger from said rest position to said firing position, and a non-enabling position, precluding movement of said trigger from said rest position to said firing position;

(D) means biasing said first safety firing means to said non-enabling position;

(E) closure means movable between an open position wherein said closure means substantially exposes said aperture of said housing and a closed position wherein said closure means substantially covers said aperture of said housing;

(F) second safety firing means also movable between an enabling position, enabling movement of said trigger from said rest position to said firing position, and a non-enabling position, precluding movement of said trigger from said rest position to said firing position; and (G) means for moving said second safety firing means from said enabling position to said non-enabling position when said closure means is not in said closed position;

said closure means including means adapted to move said second safety firing means from said non-enabling position to said enabling position when said closure means is in said closed position, whereby said trigger may be moved to said firing position only when said closure means substantially covers said aperture.

7. The gun of claim 6 wherein said means for moving said second safety firing means from said enabling position to said non-enabling position comprises biasing means.

8. The gun of claim 6 wherein said trigger is movable to said firing position only when said first safety firing means and said second safety firing means are both in said enabling positions.

9. A gun for projecting a projectile comprising:

(A) a housing having an open top adapted to received therein a magazine containing projectiles, said housing defining a handle to hold the gun and a barrel from which the projectile is projected;

(B) a manufacturer-sealed pre-loaded magazine disposed in said housing;

(C) a trigger movable relative to said housing between a rest position and a firing position;

(D) means for projecting a projectile from the magazine through said barrel and out of said gun when said trigger is moved to said firing position; and (E) a stock slidable along said barrel between a top-opening position wherein said housing open top is exposed and a top-closing position wherein said housing open top is closed by said stock; said stock further including means for cocking said projecting means as said stock moves from said top-closing position to said top-opening position, and means for indexing said magazine as said stock moves from said top-opening position to said top-closing position.

10. The gun of claim 9 including means precluding movement of said trigger to said firing position when said stock is not in said top-closing position.

11. The gun of claim 9 including means immobilizing said magazine against indexing when said stock is in said top-closing position.

12. A gun projecting a projectile comprising:

(A) a frame defining a handle for holding the gun and a barrel from which the projectile is projected;

(B) a trigger movable relative to said frame between a rest position and a firing position;

(C) means for removably receiving a magazine containing multiple projectiles within said frame adjacent the rear end of said barrel;

(D) a manufacturer-sealed pre-loaded magazine disposed in said magazine-receiving means;

(E) means for projecting a projectile from said magazine through said barrel and out of said gun when said trigger is moved to said firing position;

(F) a longitudinally extending barrel tube coaxially disposed within said barrel and longitudinally movable between a forward position, wherein the rear end of said tube is substantially spaced from said magazine, and a rearward position, wherein the rear end of said tube is closely adjacent said magazine; (G) a barrel block disposed adjacent the front of said magazine when said magazine is received in said receiving means, said block in the absence of said magazine blocking passage therethrough by the rear end of said tube to maintain said tube in its forward position and blocking access to the rear end of said tube, but in the presence of said magazine permitting passage therethrough by the rear end of said tube to allow movement of said tube to its rearward position and enabling access of a projectile from said magazine into the rear end of said tube;

whereby projectiles from said magazine may be projected into the rear end of said tube while the rear end of said tube is not accessible for firing objects not contained in said magazine.

13. The gun of claim 12 wherein said block has a member movable between a blocking position, blocking access to the rear end of said tube and maintaining said tube in its forward position, and an enabling position, allowing said tube to move through said block and into its rearward position, said block permitting movement of said movable member to said enabling position when said magazine is received by said receiving means and additionally comprising means for moving said movable member from said enabling position to said blocking position.

14. The gun of claim 13 wherein said moving means comprising means for biasing said movable member towards said blocking position.

15. The gun of claim 13 wherein said tube is in fluid-tight communication with said magazine only in its rearward position.

16. The gun of claim 13 additionally comprising means for biasing said tube to said rearward position.

17. A kit comprising:

(A) a gun for projecting a paint-containing projectile including:

(i) a frame defining a handle for holding the gun and a barrel from which the paint-containing projectile is projected; and (ii) means for removably receiving a projectile-containing magazine within said said frame adjacent the rear end of said barrel; and (B) a cleaning magazine adapted to be removably disposed within said frame adjacent to the rear end of said barrel in the manner of the projectile-containing magazine, said cleaning magazine containing a flexible cleaning rod extending therethrough, said cleaning rod having one exposed end adapted to be grasped by a person cleaning the barrel and the other end aligned with the rear end of said barrel; whereby reciprocation of said one end of said cleaning rod by the user causes the other end of said cleaning rod to enter and reciprocate within said barrel to clean the same of any accumulated paint from previously projected projectiles.

18. The kit of claim 17 wherein the gun further comprises a normally closed barrel block adapted to be opened by a projectile-containing magazine, and the cleaning magazine further comprises means for opening the barrel block.

19. The kit of claim 17 additionally including a manufacturer-sealed pre-loaded projectile-containing magazine disposed in said magazine-receiving means.

20. A projectile-containing magazine for use in a gun having a normally closed barrel block, comprising:

(A) a carousel defining sectors comprising a plurality of consecutive radial chambers for carrying projectiles, a safety sector and an empty sector;

(B) a stator containing lugs for opening a normally-closed barrel block and exposing only one of said sectors at a time for firing;

(C) means enabling indexing of said carousel from said safety sector through said projectile-containing chambers to said empty sector.

21. The magazine of claim 20 wherein said means for enabling indexing precludes indexing from said empty sector to said safety sector.

22. The magazine of claim 20 additionally comprising means for resisting indexing and precluding reverse indexing of said carousel relative to said stator.

23. The magazine of claim 22 wherein said resisting and precluding means additionally comprises means for aligning consecutively said chambers and said empty sector in a position for firing.

* * * * *